US007497543B2

(12) United States Patent
Ootsuka

(10) Patent No.: US 7,497,543 B2
(45) Date of Patent: Mar. 3, 2009

(54) LIQUID EJECTION APPARATUS AND EJECTION ABNORMALITY FACTOR EXTRACTION METHOD

(75) Inventor: Hiroyuki Ootsuka, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 295 days.

(21) Appl. No.: 11/594,069

(22) Filed: Nov. 8, 2006

(65) Prior Publication Data

US 2007/0103500 A1 May 10, 2007

(30) Foreign Application Priority Data

Nov. 9, 2005 (JP) ..... 2005-325376

(51) Int. Cl.
*B41J 2/19* (2006.01)
*B41J 29/393* (2006.01)

(52) U.S. Cl. ..... 347/19; 347/92

(58) Field of Classification Search ..... 347/19, 347/92

See application file for complete search history.

(56) References Cited

U.S. PATENT DOCUMENTS

2006/0071964 A1* 4/2006 Oku ..... 347/19

FOREIGN PATENT DOCUMENTS

JP 10-114074 A 5/1998
JP 2004-276367 A 10/2004

* cited by examiner

*Primary Examiner*—Julian D Huffman
(74) *Attorney, Agent, or Firm*—Birch, Stewart, Kolasch & Birch, LLP

(57) ABSTRACT

The liquid ejection apparatus includes: a liquid ejection head including a nozzle which ejects liquid, a pressure chamber which is connected to the nozzle and is to be filled with the liquid, a pressure generating element which pressurizes the liquid in the pressure chamber, and a pressure determination element which determines a pressure inside the pressure chamber and outputs a pressure determination signal; a storage device which stores a peak value of the pressure determination signal output by the pressure determination element in a state where the nozzle ejects the liquid normally; a first ejection abnormality factor extraction device which extracts a first ejection abnormality factor by comparing the peak value stored previously in the storage device with the pressure determination signal output by the pressure determination element during a prescribed period for ejection abnormality determination; a threshold value variably setting device which sets a threshold value for extracting a second ejection abnormality factor according to a differential between the peak value stored previously in the storage device and a peak value of the pressure determination signal output by the pressure determination element during the prescribed period for ejection abnormality determination; a pulse generation device which is capable of generating pulses according to a comparison result between the threshold value set by the threshold value variably setting device and the pressure determination signal output by the pressure determination element during the prescribed period for ejection abnormality determination; and a measurement device which extracts the second ejection abnormality factor by measuring a time interval of the pulses generated by the pulse generation device.

2 Claims, 18 Drawing Sheets

LIQUID EJECTION APPARATUS AND EJECTION ABNORMALITY FACTOR EXTRACTION METHOD

BACKGROUND OF THE INVENTION

1. Field of the Invention

The present invention relates to a liquid ejection apparatus and an ejection abnormality factor extraction method, and more particularly, to a liquid ejection apparatus which ejects liquid from a nozzle and an ejection abnormality factor extraction method which extracts a factor of an ejection abnormality.

2. Description of the Related Art

Inkjet recording apparatuses are known which comprise an inkjet head having a plurality of nozzles, and which record images onto a medium by ejecting ink toward the medium from the inkjet head.

In an inkjet recording apparatus, cases may occur in which the nozzles become blocked and it is impossible to eject ink droplets because of increase in the viscosity of the ink, infiltration of air bubbles into the inkjet head, adherence of paper dust to the ink ejection surface, and the like. If nozzle blockages of this kind arise, then dot defects occur in the image formed on the medium, thus causing degradation of the image quality.

In the related art, various types of liquid ejection apparatus having a device for determining ejection abnormalities have been proposed.

For example, Japanese Patent Application Publication No. 10-114074 discloses an ejection head comprising piezoelectric elements (electrostrictive vibrating elements) provided respectively in the ink flow channels for a plurality of nozzles, which ejects ink by applying a drive voltage to the piezoelectric elements, wherein an air bubble determination device is provided in order to detect the presence or absence of air bubbles in the ink flow channels by determining constantly, during printing, whether or not the voltage generated in the piezoelectric elements due to the volume change of the ink flow channels is an overvoltage which is not less than the drive voltage.

Moreover, Japanese Patent Application Publication No. 2004-276367 (in particular, FIGS. 16, 18, 19, and 22) discloses an apparatus comprising: an ejection head that ejects liquid inside pressure chambers (cavities) from nozzles by means of a diaphragm which can be displaced by driving actuators; and an ejection abnormality measuring device which determines the residual vibration of the diaphragm and determines ejection abnormalities due to adherence of paper dust to the vicinity of the nozzles of the head on the basis of the pattern of the residual vibration of the diaphragm thus determined. The ejection abnormality determination device comprises: a vibration determination device including an oscillation circuit which converts a variation in the electrostatic capacitance into a frequency, a frequency-voltage conversion circuit (F/V conversion circuit) which converts the frequency into a voltage; a residual waveform determination device having a waveform shaping circuit; a measurement device which measures the frequency and amplitude of the residual vibration waveform obtained by the residual waveform determination device; and a determination device which determines ejection abnormalities according to the measurement results from the measurement device.

However, in such liquid ejection apparatuses of the related art, there is a possibility that the circuit composition becomes complicated in a case where the liquid ejection apparatus is intended to extract various types of factors of ejection abnormalities, such as increased viscosity of the ink, the occurrence of air bubbles, adherence of dust such paper dust, and the like.

Japanese Patent Application Publication No. 10-114074 discloses a technology for determining whether the voltage generated in the driving piezoelectric element is the overvoltage which is not less than a drive voltage or not, in order to detect air bubbles. Thus determinable factors of the ejection abnormalities are limited to the presence of air bubbles only.

Japanese Patent Application Publication No. 2004-276367 discloses a technology in which the ejection abnormality determination device includes the oscillation circuit (for example, a CR oscillation circuit) which converts a electrostatic capacitance variation based on the residual vibration of the diaphragm into a frequency, the F/V conversion circuit which converts a frequency into a voltage, and the waveform shaping circuit. Therefore, the circuit composition is complicated and is generally expensive. Moreover, since ejection abnormalities are determined on the basis of the residual vibrations of the diaphragm, it is difficult to achieve highly accurate determination of ejection abnormalities.

SUMMARY OF THE INVENTION

The present invention has been contrived in view of the foregoing circumstances, an object thereof being to provide a liquid ejection apparatus and an ejection abnormality factor extraction method whereby various types of ejection abnormality factors, such as increased ink viscosity, the occurrence of an air bubble and adherence of dust, can be reliably extracted with a simple circuit composition.

In order to attain the aforementioned object, the present invention is directed to a liquid ejection apparatus, comprising: a liquid ejection head including a nozzle which ejects liquid, a pressure chamber which is connected to the nozzle and is to be filled with the liquid, a pressure generating element which pressurizes the liquid in the pressure chamber, and a pressure determination element which determines a pressure inside the pressure chamber and outputs a pressure determination signal; a storage device which stores a peak value of the pressure determination signal output by the pressure determination element in a state where the nozzle ejects the liquid normally; a first ejection abnormality factor extraction device which extracts a first ejection abnormality factor by comparing the peak value stored previously in the storage device with the pressure determination signal output by the pressure determination element during a prescribed period for ejection abnormality determination; a threshold value variably setting device which sets a threshold value for extracting a second ejection abnormality factor according to a differential between the peak value stored previously in the storage device and a peak value of the pressure determination signal output by the pressure determination element during the prescribed period for ejection abnormality determination; a pulse generation device which is capable of generating pulses according to a comparison result between the threshold value set by the threshold value variably setting device and the pressure determination signal output by the pressure determination element during the prescribed period for ejection abnormality determination; and a measurement device which extracts the second ejection abnormality factor by measuring a time interval of the pulses generated by the pulse generation device.

According to this aspect of the present invention, the first ejection abnormality factor and the second ejection abnormality factor are extracted by the first ejection abnormality factor extraction device and the second ejection abnormality factor extraction device, respectively. Thus, it is possible to extract a plurality of types of ejection abnormality factors. For example, increased viscosity of the ink, which greaten the amplitude of a pressure determination signal, can be extracted as the first ejection abnormality factor, and the presence of an air bubble or the adherence of paper dust can be extracted as the second ejection abnormality factor that is an ejection abnormality factor other than the first ejection abnormality factor.

The first ejection abnormality factor is extracted by comparing the peak value of the pressure determination signal in the normal ejection state, which is stored previously in the storage device, with the pressure determination signal obtained from the pressure determination element during the period for ejection abnormality determination. According to this composition, it is possible to adopt a simple circuit composition for this extraction processing. For example, the first ejection abnormality factor extraction device may be constituted principally by a comparator.

Moreover, the second ejection abnormality factor is extracted by means of the threshold value variably setting device which sets a threshold value variably in accordance with the differential between the peak value stored previously in the storage device while the ejection state is normal and the peak value of the pressure determination signal during the period for ejection abnormality determination, the pulse generation device which compares the threshold value set by the threshold value variably setting device with the pressure determination signal during the period for ejection abnormality determination, and the measurement device which measures the time interval of pulse. According to this composition, it is possible to adopt a simple circuit composition for this extraction processing. For example, the threshold value variably setting device is constituted principally by a differential amplifier (operating amplifier), the pulse generation device is constituted principally by a comparator, and the measurement device is constituted principally by a counter.

Since the threshold value used for generating a pulse is set appropriately in accordance with the peak value in the normal ejection state and the peak value of the pressure determination signal during the period for ejection abnormality determination, then it is possible to extract an ejection abnormality factor more precisely and reliably, in comparison with a case where a fixed threshold value is used. It is possible to extract reliably, for example, ejection abnormality factors that cause changes in the amplitude of the pressure determination signal and the frequency of same, such as the occurrence of a large-sized air bubble, the occurrence of a medium or small-sized air bubble, the adherence of paper dust, and the like.

Furthermore, since the pressure in the pressure chamber is determined by the pressure determination element, for example, which is provided on the wall surface of the pressure chamber, and ejection abnormalities are determined on the basis of the pressure determination signal output from this pressure determination element, then it is possible to reliably determine ejection abnormalities.

In order to attain the aforementioned object, the present invention is also directed to an ejection abnormality factor extraction method for a liquid ejection head including a nozzle which ejects liquid, a pressure chamber which is connected to the nozzle and is to be filled with the liquid, a pressure generating element which pressurizes the liquid in the pressure chamber, and a pressure determination element which determines a pressure inside the pressure chamber and outputs a pressure determination signal, the method comprising the steps of: extracting a first ejection abnormality factor by previously storing, in a prescribed storage device, a peak value of the pressure determination signal output by the pressure determination element in a state where the nozzle ejects the liquid normally, and by comparing the peak value stored previously in the prescribed storage device with the pressure determination signal output by the pressure determination element during a prescribed period for ejection abnormality determination; setting a threshold value for extracting a second ejection abnormality factor according to a differential between the peak value stored previously in the prescribed storage device and a peak value of the pressure determination signal output by the pressure determination element during the prescribed period for ejection abnormality determination; generating pulses according to a comparison result between the threshold value and the pressure determination signal output by the pressure determination element during the period for ejection abnormality determination; and extracting the second ejection abnormality factor by measuring a time interval of the pulses.

According to the present invention, it is possible to reliably extract various types of factors of the ejection abnormality, such as increased viscosity of the liquid, the occurrence of an air bubble, and the adherence of dust, by means of a simple circuit composition.

BRIEF DESCRIPTION OF THE DRAWINGS

The nature of this invention, as well as other objects and benefits thereof, is explained in the following with reference to the accompanying drawings, in which like reference characters designate the same or similar parts throughout the figures and wherein.

DESCRIPTION OF THE PREFERRED EMBODIMENTS

General Configuration of Inkjet Recording Apparatus

Figure 1:
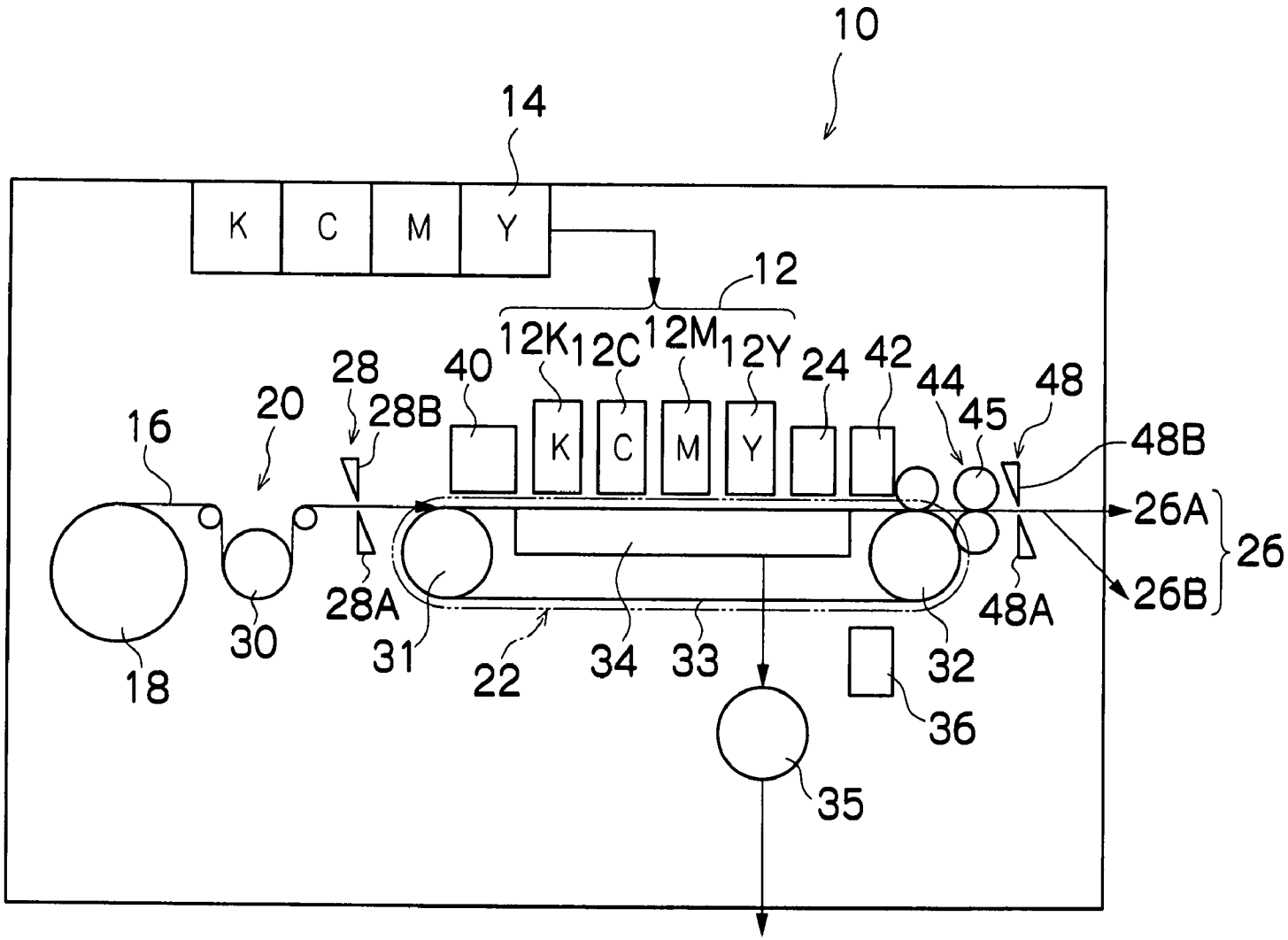
FIG. 1 is a general schematic drawing showing an inkjet recording apparatus according to an embodiment of the present invention.

FIG. 1 is a general configuration diagram showing an inkjet recording apparatus (a liquid ejection apparatus) according to an embodiment of the present invention. As shown in FIG. 1, the inkjet recording apparatus 10 comprises: a printing unit 12 having a plurality of inkjet heads (hereafter, called "heads") 12K, 12C, 12M and 12Y provided for ink colors of black (K), cyan (C), magenta (M), and yellow (Y), respectively; an ink storing and loading unit 14 for storing inks of K, C, M and Y to be supplied to the heads 12K, 12C, 12M and 12Y; a paper supply unit 18 for supplying recording paper 16 which is a recording medium; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; and a paper output unit 26 for outputting an image-printed recording paper (printed matter) to the exterior.

The ink storing and loading unit 14 has ink supply tanks for storing the inks of K, C, M and Y to be supplied to the heads 12K, 12C, 12M and 12Y, and the tanks are connected to the heads 12K, 12C, 12M and 12Y by means of prescribed channels. The ink storing and loading unit 14 has a warning device (for example, a display device or an alarm sound generator) for warning when the remaining amount of any ink is low, and has a mechanism for preventing loading errors among the colors.

As shown in FIG. 1, a composition which has a magazine for rolled paper (continuous paper) as an embodiment of the paper supply unit 18 is adopted; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper 16 can be used, it is preferable that an information recording medium such as a bar code or a wireless tag containing information about the type of paper is attached to the magazine, and by reading the information contained in the information recording medium with a predetermined reading device, the type of recording paper 16 to be used (type of medium) is automatically determined, and ink droplet ejection is controlled so that the ink droplets are ejected in an appropriate manner in accordance with the type of medium.

The recording paper 16 delivered from the paper supply unit 18 retains curl because of having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has the curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A whose length is not less than the width of the conveyor pathway of the recording paper 16, and a round blade 28B which moves along the stationary blade 28A. The stationary blade 28A is disposed on the opposite side of the conveyor pathway from the printed surface, and the round blade 28B is disposed on the printed surface side across the conveyor pathway. When cut papers are used, the cutter 28 is not required.

The recording paper 16 that is decurled and cut is delivered to the suction belt conveyance unit 22. The suction belt conveyance unit 22 has a configuration in which an endless belt 33 is set around rollers 31 and 32 so that the portion of the endless belt 33 facing at least the nozzle faces of the printing unit 12 forms a horizontal plane (flat plane).

The belt 33 has a width that is greater than the width of the recording paper 16, and a plurality of suction apertures (not shown) are formed on the belt surface. A suction chamber 34 is disposed in a position facing the nozzle surfaces of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor (88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration of nipping a brush roller and a water absorbent roller, an air blow configuration in which clean air is blown, and a combination of these. In the case of the configuration of nipping the cleaning rollers, it is preferable to make the line velocity of the cleaning rollers different from that of the belt to improve the cleaning effect.

The inkjet recording apparatus 10 can comprise a roller nip conveyance mechanism, instead of the suction belt conveyance unit 22. However, there is a possibility in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
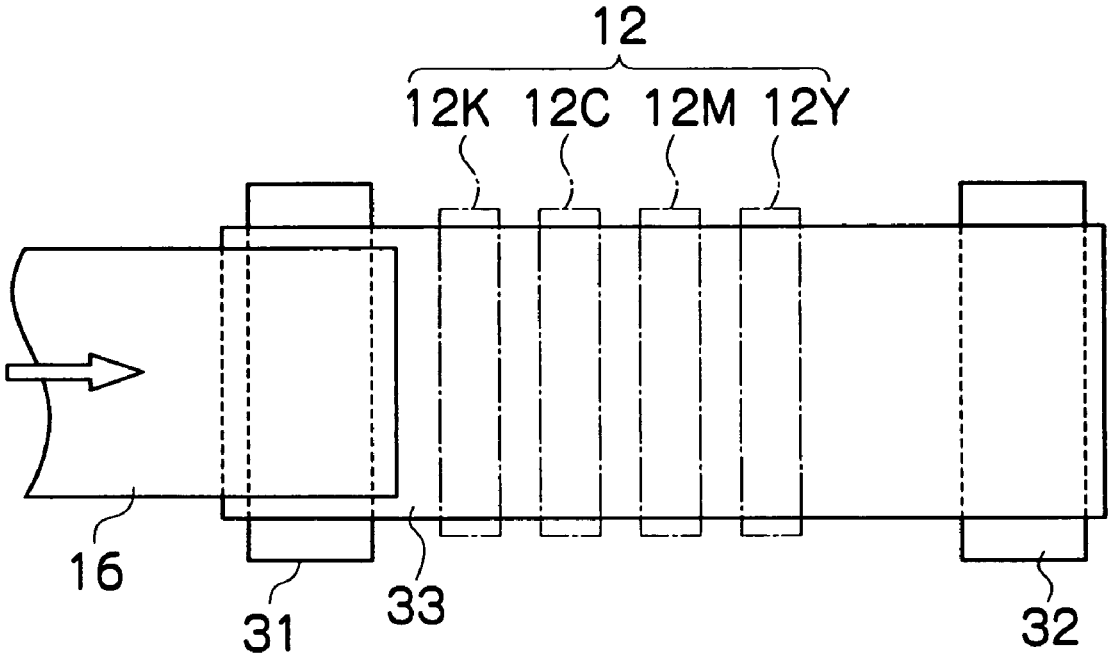
FIG. 2 is a principal plan diagram showing the peripheral area of a print unit in the inkjet recording apparatus shown in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording paper 16 (i.e., the full width of the printable range) (see FIG. 2).

The heads 12K, 12C, 12M and 12Y are arranged in color order (black (K), cyan (C), magenta (M), yellow (Y)) from the upstream side in the feed direction (paper feed direction) of the recording paper 16, and these heads 12K, 12C, 12M and 12Y are fixed extending in a direction substantially perpendicular to the paper conveyance direction.

A color image can be formed on the recording paper 16 by ejecting inks of different colors from the heads 12K, 12C, 12M and 12Y, respectively, toward the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation (one sub-scanning operation) of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is adopted in the present embodiment, combinations of the ink colors and the number of colors are not limited to those. Light inks, dark inks or special color inks can be added as required. For example, a configuration is possible in which inkjet heads for ejecting light-colored inks such as light 15 cyan and light magenta are added. Furthermore, there are no particular restrictions of the sequence in which the heads of respective colors are arranged.

A post-drying unit 42 is disposed following the print unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is being heated, and the uneven shape is transferred to the image surface.

The printed matter generated in this manner is output from the paper output unit 26. The target print (i.e., the result of printing the target image) and the test print are preferably output separately. In the inkjet recording apparatus 10, a sorting device (not shown) is provided for switching the outputting pathways in order to sort the printed matter with the target print and the printed matter with the test print, and to send them to paper output units 26A and 26B, respectively.

When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as that of the first cutter 28 described above, and includes a stationary blade 48A and a round blade 48B.

Although not shown in FIG. 1, the paper output unit 26A for the target prints is provided with a sorter for collecting prints according to print orders.

Structure of the Liquid Ejection Head

Next, the structure of a liquid ejection head (hereinafter referred to as a head) is described. The heads 12K, 12C, 12M and 12Y of the respective ink colors have the same structure, and a reference numeral 50 is hereinafter designated to any of the heads.

Figure 3A:
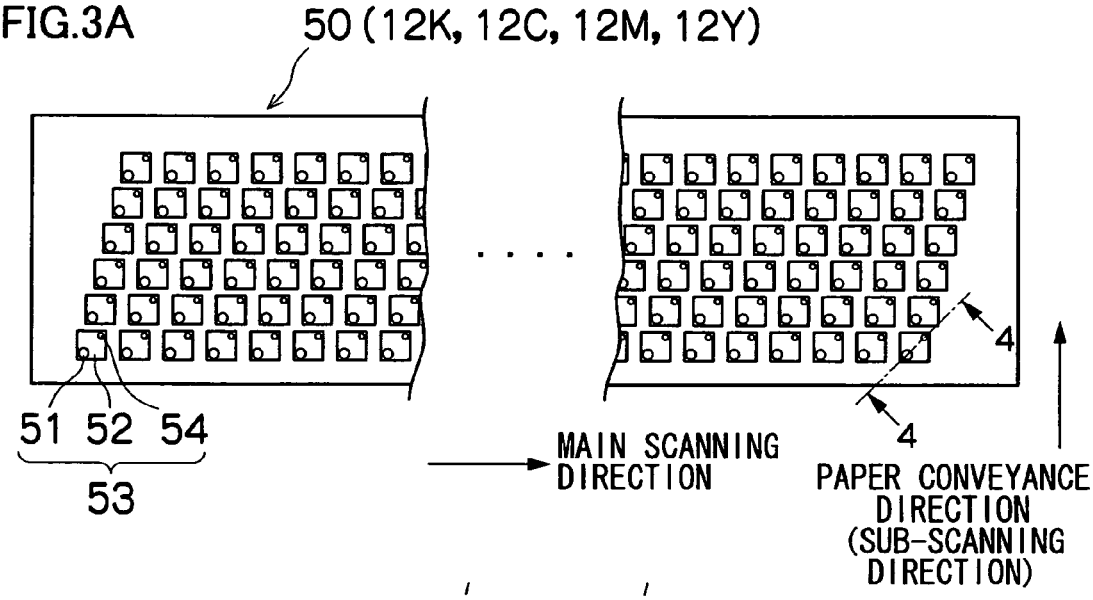
FIGS. 3A to 3C are plan view perspective diagrams showing embodiments of the composition of a print head.
Figure 3B:
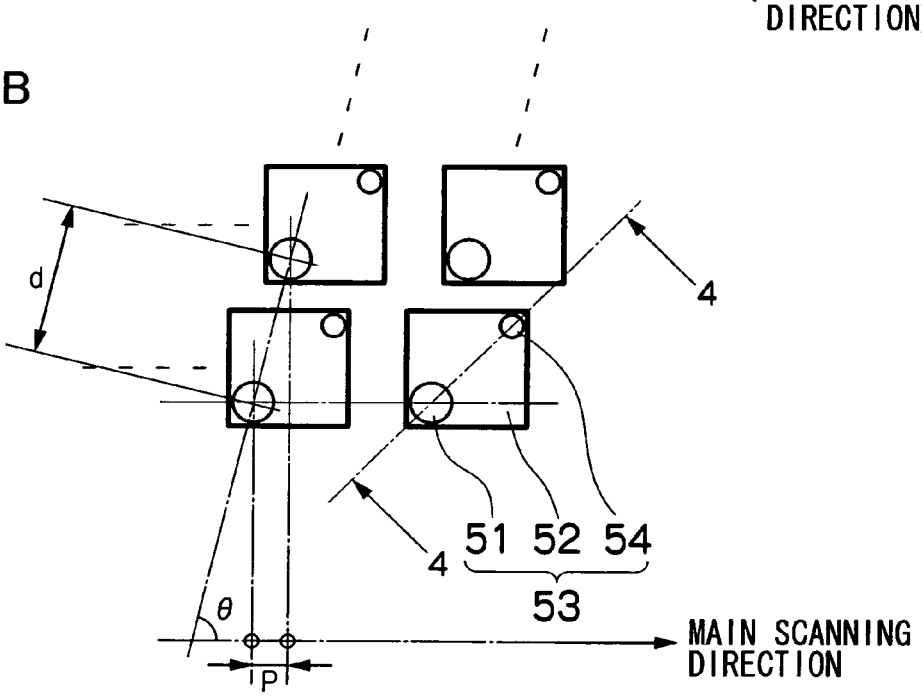
Figure 3C:
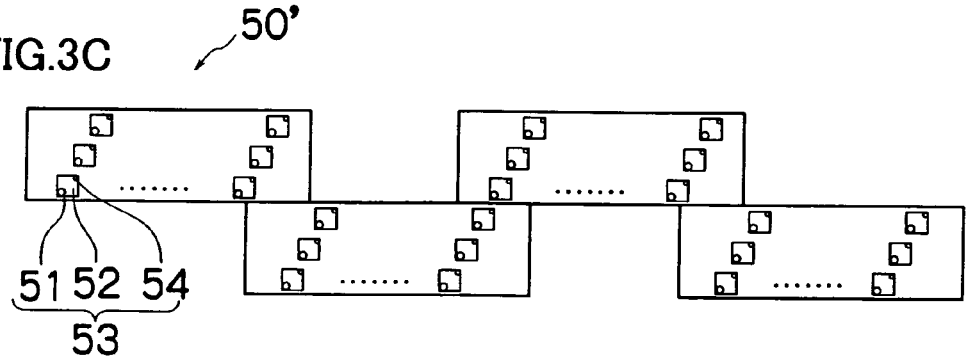
Figure 4:
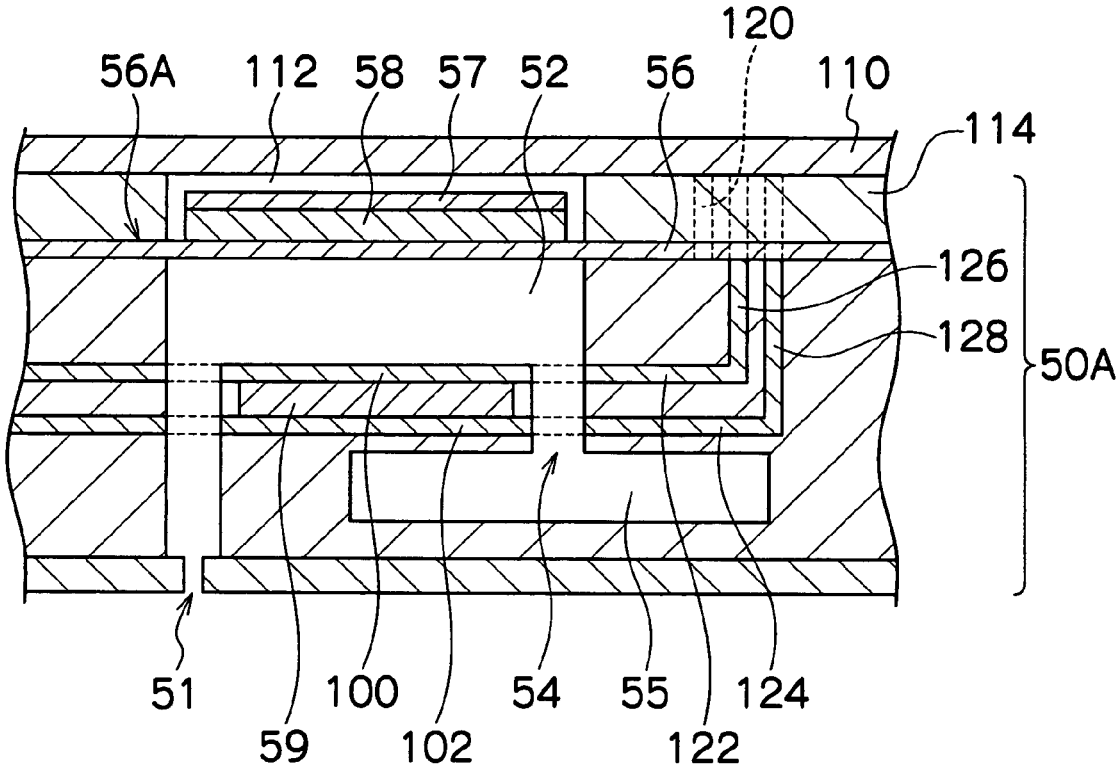
FIG. 4 is a cross-sectional diagram showing the three-dimensional structure of a head.

FIG. 3A is a plan view perspective diagram showing an embodiment of the structure of a head 50, and FIG. 3B is an enlarged diagram of a portion of same. Furthermore, FIG. 3C is a plan view perspective diagram showing a further embodiment of the composition of a head 50, and FIG. 4 is a cross-sectional diagram showing a three-dimensional composition of an ink chamber unit (being a cross-sectional view along line 4-4 in FIGS. 3A and 3B).

The nozzle pitch in the head 50 is required to be minimized in order to maximize the density of the dots formed on the surface of the recording paper 16. As shown in FIGS. 3A to 3C, the head 50 according to the present embodiment has a structure in which a plurality of ink chamber units (ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the main-scanning direction perpendicular to the paper conveyance direction) is reduced and high nozzle density is achieved.

The composition of forming one or more nozzle rows through a length corresponding to the entire width of the recording paper 16 in a direction substantially perpendicular to the conveyance direction of the recording paper 16 is not limited to the embodiment described above. For example, instead of the configuration as described with reference to FIG. 3A, a line head having nozzle rows of a length corresponding to the entire width of the recording paper 16 can be formed by arranging and combining, in a staggered matrix, short head blocks 50' having a plurality of nozzles 51 arrayed in a two-dimensional fashion, as shown in FIG. 3C.

Although an aspect of the present embodiment is described in which the planar shape of the pressure chambers 52 is substantially a square shape, the planar shape of the pressure chambers 52 is not limited to a substantially square shape, and it is possible to adopt various other shapes, such as a substantially circular shape, a substantially elliptical shape, a substantially parallelogram (diamond) shape, or the like. Furthermore, the arrangement of the nozzles 51 and the supply ports 54 is not limited to the arrangement shown in FIGS. 3A to 3C, and it is also possible to arrange nozzles 51 substantially in the central regions of the pressure chambers 52, or to arrange the supply ports 54 on the side wall side of the pressure chambers 52.

As shown in FIG. 3B, the high-density-nozzle head according to the present embodiment is achieved by arranging a plurality of nozzles in a lattice configuration, according to a fixed arrangement pattern following a row direction which is parallel with the main scanning direction, and an oblique column direction which forms a prescribed non-perpendicular angle θ with respect to the main scanning direction.

In other words, by adopting a structure in which a plurality of ejection elements 53 are arranged at a uniform pitch d in line with a direction forming an angle of θ with respect to the main scanning direction, the pitch P of the nozzles 51 projected to an alignment in the main scanning direction is d×cos θ, and hence it is possible to treat the nozzles as if they are arranged linearly at a uniform pitch of P. By means of this composition, it is possible to achieve a nozzle composition of high density, in which the nozzle columns projected to an alignment in the main scanning direction reach a total of 2400 per inch (2400 nozzles per inch).

When implementing the present invention, the arrangement structure of the nozzles is not limited to the embodiment shown in FIG. 3A, and it is also possible to employ various other types of nozzle arrangements, such as an arrangement structure having one nozzle row in the sub-scanning direction.

FIG. 4 is a cross-sectional diagram showing the three-dimensional composition of an ejection element 53.

As shown in FIG. 4, a piezoelectric actuator (pressure generating element) which pressurizes the ink inside a pressure chamber 52 is provided on the wall of the pressure chamber 52, which is filled with ink and is connected to a nozzle 51 for ejecting ink. Specifically, a piezoelectric actuator 58 provided with an individual electrode 57 is bonded to the pressure plate 56 which forms the upper face of the pressure chambers 52 and also serves as a common electrode. The piezoelectric actuator 58 is deformed when a drive voltage (drive signal) is applied to the individual electrode 57, thereby causing ink to be ejected from the nozzle 51. When ink has been ejected, new ink is supplied to the pressure chamber 52 from a common flow passage 55, via a supply port 54.

On the other hand, when a pressure sensor 59 (determination element) which is provided on the wall of the pressure chamber 52 so as to oppose the piezoelectric actuator 58 is subjected to pressure due to ejection or refilling of the ink, or the like, then distortion (stress) corresponding to this pressure occurs in the pressure sensor 59, and a voltage corresponding to this distortion can be obtained from the pressure sensor 59 as a determination signal (pressure determination signal). In other words, it is possible to extract a voltage (waveform) corresponding to the pressure generated in the pressure chamber 52, from the pressure sensor 59.

In the present inkjet recording apparatus 10, ejection abnormality factors are extracted on the basis of the pressure determination signals obtained from the pressure sensors 59.

The pressure sensor 59 is provided with extraction electrodes 100 and 102 for the pressure determination signal. The extraction electrodes 100 and 102 are provided respectively on a surface of the pressure sensor 59 adjacent to the pressure chamber 52 and a surface reverse to same, in such a manner that pressure determination signals are obtained from the extraction electrode 100 on the pressure chamber side and the extraction electrode 102 on the side opposite to the pressure chamber.

For the pressure sensor 59 shown in the present embodiment, a floating-output type pressure sensor is used in which the extraction electrode 102 outputs an inverted signal which is the same as a signal obtained by inverting the pressure determination signal output from the extraction electrode 100. In other words, the pressure determination signal obtained from the extraction electrode 100 and the pressure determination signal obtained from the extraction electrode 102 have substantially the same phase and have a mutually inverse relationship.

The surface of the extraction electrode 100 on the pressure chamber side and the rear surface of the extraction electrode 102 opposite from the pressure chamber 52 are insulated. Furthermore, it is preferable that a cavity part be provided on the opposite side of the extraction electrode 102 for the pressure sensor 59 from the pressure chamber 52, in such a manner that the displacement of the pressure sensor 59 is not obstructed.

Furthermore, a flexible cable 110 (a flexible printed circuit board) having a wiring pattern (not shown) for transmitting drive signals to be applied to the piezoelectric actuators 58 and pressure determination signals obtained from the pressure sensors 59 is provided on the rear side of the piezoelectric actuators 58 with respect to the pressure plate 56. In the space surrounded by the flexible cable 110 and the pressure plate 56, a cavity part 112 between each piezoelectric actuator 58 and the flexible cable 110, and a supporting member 114 which supports the flexible cable 110 from below are formed.

By providing the cavity part 112 above each piezoelectric actuator 58 (between each piezoelectric actuator 58 and the flexible cable 110), the displacement of each piezoelectric actuator 58 is not restricted, and hence it is possible to suppress loss of the pressure generated by the piezoelectric actuators 58 when the piezoelectric actuators 58 are driven.

The flexible cable 110 has a composition which includes a supporting layer (insulating layer) made of a resin material, such as epoxy or polyimide, and a conducting layer made of copper, or the like, which is provided with the supporting layer. In the present embodiment, the flexible cable used has a multi-layer structure in which a three or more conducting layers and a plurality of supporting layers are bonded together alternately.

The individual electrodes 57 for the piezoelectric actuators 58 are connected to horizontal wires (not shown) formed on the piezoelectric actuator installation surface 56A of the pressure plate 56 (in other words, the individual electrodes 57 are extended to the piezoelectric actuator installation surface of the pressure plate 56 and are bonded electrically to the horizontal wires), and each of the horizontal wires is connected to a vertical wire 120 (denoted by broken lines in the diagram) penetrating through the supporting member 114. Moreover, the vertical wires 120 are electrically connected to the wiring pattern of the flexible cable 110.

In other words, drive signals to be applied to the piezoelectric actuators 58 are transmitted from the head driver (denoted by reference numeral "84" in FIG. 7) to the individual electrodes 57 for the piezoelectric actuators 58, through the wiring pattern of the flexible cable 110, the vertical wires 120, and the horizontal wires (not shown).

Figure 7:
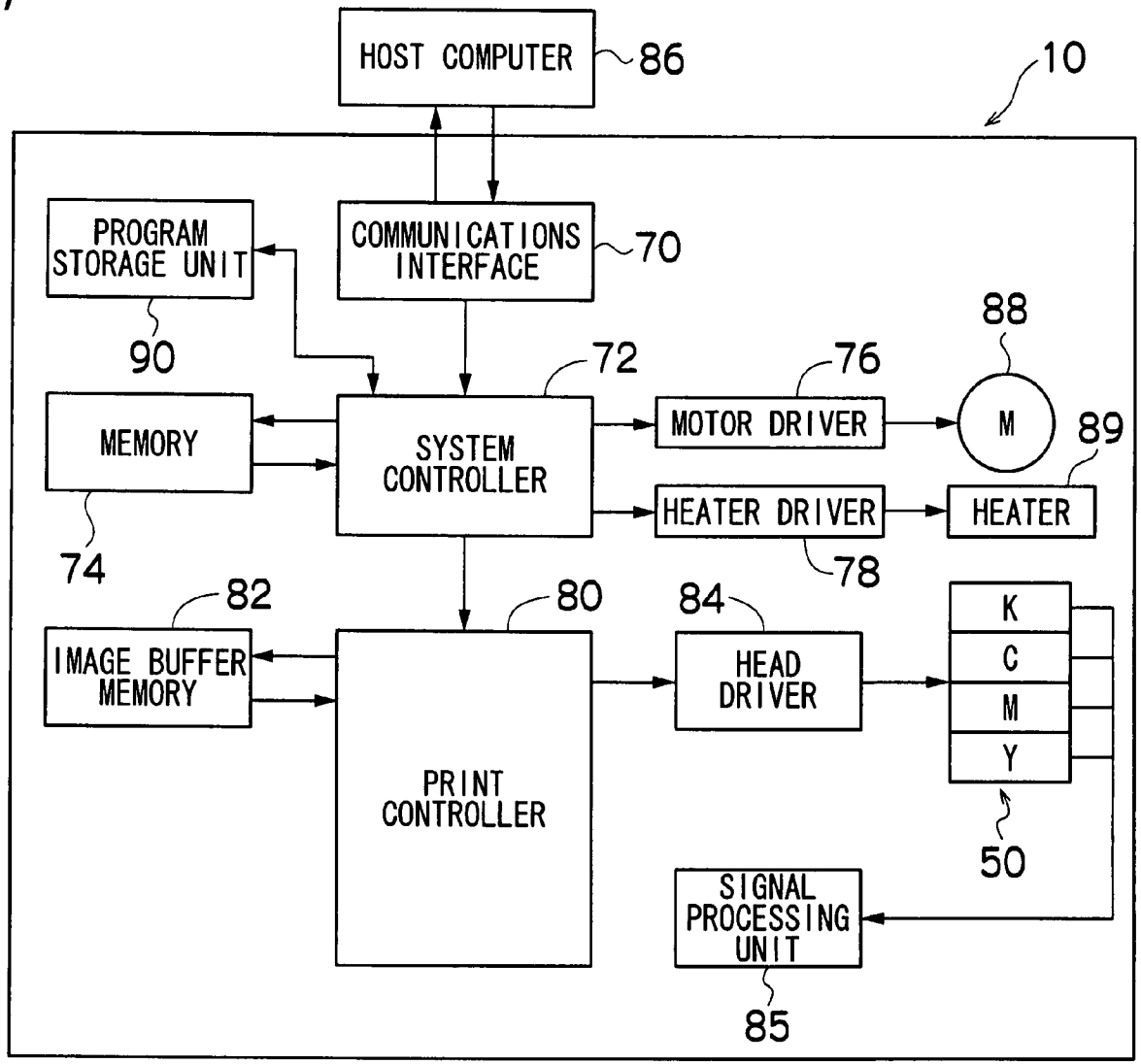
FIG. 7 is a principal block diagram showing a system configuration of the inkjet recording apparatus shown in FIG. 1.

Furthermore, the pressure determination signals obtained from the pressure sensors 59 are transmitted to the signal processing unit 85 shown in FIG. 7, via the extraction electrodes 100 and 102, horizontal wires 122 and 124 connected respectively to the extraction electrodes 100 and 102, the flow channel structure 50A, the pressure plate 56, vertical wires 126 and 128 penetrating the supporting member 114, and the wiring pattern of the flexible cable 110.

In other words, the drive signal wires, in which the drive signals are transmitted, include the wiring pattern of the flexible cable 110, the vertical wires 120, and the horizontal wires (not shown). On the other hand, the pressure determination signal wires, in which the pressure determination signals are transmitted, include the wiring pattern of the flexible cable 110, the vertical wires 126 and 128, and the horizontal wires 122 and 124.

For the piezoelectric actuators 58 as shown in FIG. 4, it is suitable to adopt a piezoelectric element using ceramic material, such as PZT ($Pb(Zr.Ti)O_3$, lead zirconate titanate). For the pressure sensors 59, it is suitable to adopt a piezoelectric element using a fluoride resin material, such as a PVDF (polyvinylidene fluoride) or PVDF-TrFE (a copolymer of polyvinylidene fluoride and trifluoride ethylene).

In general, for an actuator which generates the ejection force, it is preferable to use a piezoelectric element having large absolute values of the equivalent piezoelectric constants (e.g., "d constant", "electrical-mechanical conversion constant", or "piezoelectric distortion constant") and excellent drive characteristics. On the other hand, for a pressure sensor which determines pressure, it is preferable to use a piezoelectric element having large values for the piezoelectric output coefficients (e.g., "g constant", "mechanical-electrical conversion constant", "piezoelectric stress constant") and excellent determination characteristics. In other words, a ceramic material, such as PZT, is suitable for a piezoelectric element having excellent drive characteristics, whereas a fluorine-based resin material, such as PVDF or PVDF-TrFE, is suitable for a piezoelectric element having excellent determination characteristics. An example of the ceramic material is lead zirconate titanate (($Pb(Zr.Ti)O_3$) that is basically composed of lead titanate ($PbTiO_3$), which is a ferroelectric material, and lead zirconate ($PbZrO_3$), which is an antiferroelectric material. By changing the mixing ratio of these two components, it is possible to control various properties of the ceramic material, such as the piezoelectric, dielectric and elastic characteristics.

The piezoelectric actuator 58 which applies the ejection force to the ink inside the pressure chamber 52, and the pressure sensor 59 which determines the pressure inside the pressure chamber 52 are not limited to being arranged in the positions shown in FIG. 4, and a configuration is possible in which the piezoelectric actuator 58 and the pressure sensor 59 is provided on the same wall of the pressure chamber 52, or on different walls of the pressure chamber 52 respectively. Moreover, a mode is also possible in which the piezoelectric actuator 58 and the pressure sensor 59 are provided inside the pressure chamber 52. In a mode where the piezoelectric actuator 58 and the pressure sensor 59 are provided inside the pressure chamber 52, a prescribed ink resistance processing (e.g., insulation treatment) is applied to the parts of the piezoelectric actuator 58 and the pressure sensor 59 that are exposed to the ink.

Figure 5:
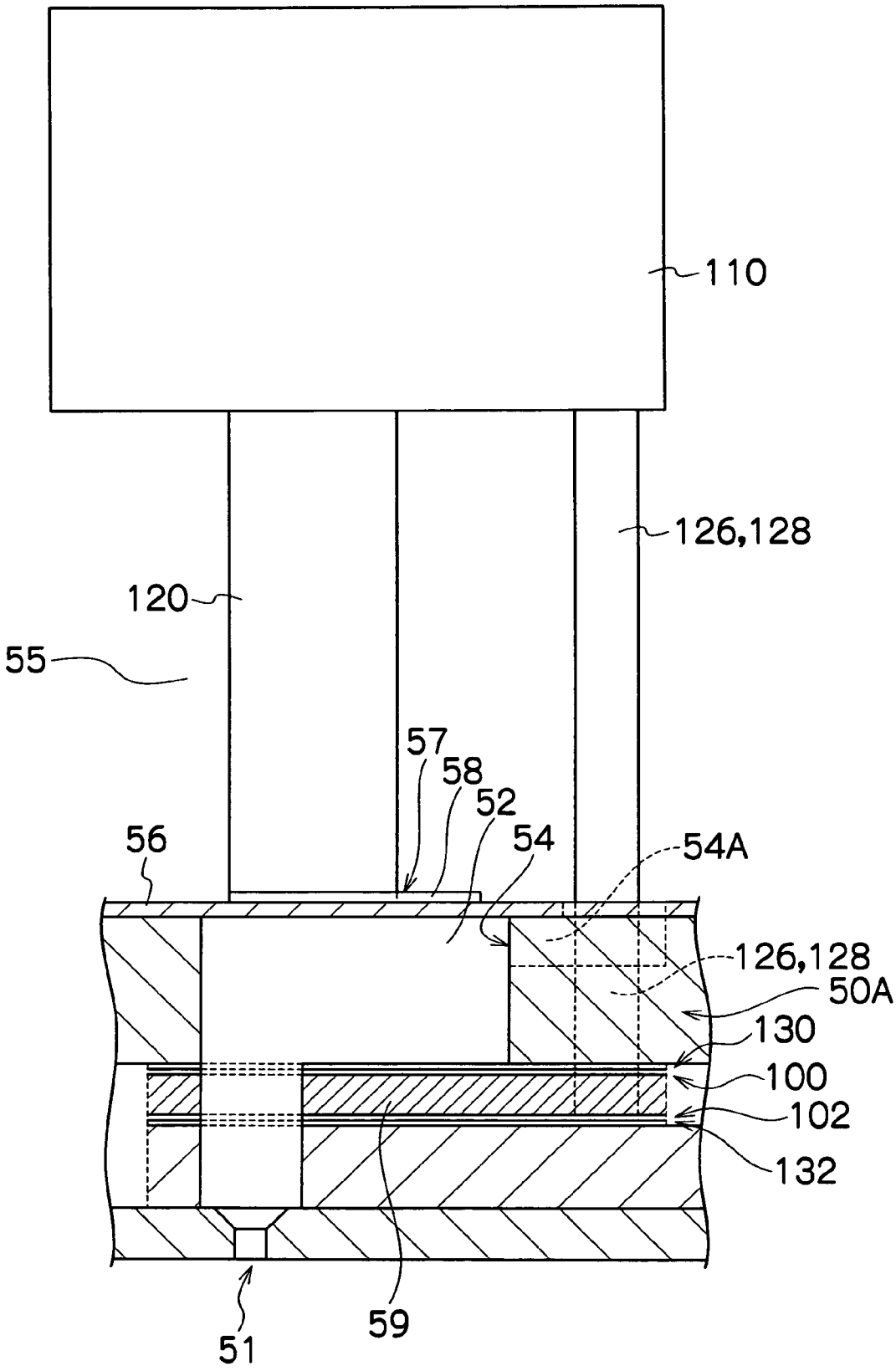
FIG. 5 is a cross-sectional diagram showing another mode of the head shown in FIG. 4.

FIG. 5 is a diagram showing another embodiment of the structure of a head 50. The head 50 shown in FIG. 5 has a vertical wire 120 which is formed so as to rise up in a vertical direction from an individual electrode 57 for a piezoelectric actuator 58 which is provided to correspond with a pressure chamber 52.

Moreover, vertical wires 126 and 128 which transmit pressure determination signals are formed so as to rise up from extraction electrodes 100 and 102 for a pressure sensor 59 and pass through a flow channel structure 50A, the pressure plate 56, and a space where the vertical wires 120 are erected (i.e., formed so as to be erected in the space where the vertical wires 120 are disposed). The reference numerals 130 and 132 shown in FIG. 5 denote an insulating layer (protecting layer) formed on the pressure chamber side of the extraction electrode 100 for the pressure sensor 59, and an insulating layer formed on the rear side of the extraction electrode 102 with respect to the pressure chamber 59, respectively.

In this way, the space in which the column-shaped vertical wires 120, 126 and 128 are erected between the pressure plate 56 and the flexible cable 110 forms a common flow channel (common liquid chamber) 55 for supplying ink to the pressure chambers 52 via supply side flow channels 54A and supply ports (supply restrictors) 54.

Although just a single ejection element 53 including a nozzle 51, a pressure chamber 52 and a piezoelectric actuator 58 is depicted and only a portion of the common flow channel 55 and the flexible cable 110 is depicted in FIG. 5, the common flow channel 55 of the present embodiment constitutes one large space formed over the whole region in which the pressure chambers 52 are formed, in order to supply ink to all of the pressure chambers 52 shown in FIG. 3A. The structure of the common flow channel 55 is not limited to a structure in which the common flow channel 55 is formed as a single large space in this way, and it may also be formed as a plurality of spaces by dividing it into several regions.

The vertical wires 120, 126 and 128 shown in FIG. 5 support the flexible cable 110 from below and create a space which forms the common flow channel 55. The vertical wires 120 which rise up as columns in this way may be referred to as "electrical columns", and the vertical wires 126 and 128 may be referred to as "pressure sensor columns". In the present embodiment, each of the vertical wires 120 is formed in a one-to-one correspondence with each of the piezoelectric actuators 58, and the vertical wires 126 and 128 are formed respectively in a one-to-one correspondence with the extraction electrodes 100 and 102 for the pressure sensors 59. In order to reduce the number of wires, the wires corresponding to a plurality of piezoelectric actuators 58 may be gathered together into a single vertical wire 120, and the wires corresponding to a plurality of pressure sensors 59 may be gathered into a single vertical wire 126 and a single vertical wire 128 (or a single vertical wire 126 and 128).

Description of an Ink Supply System

Figure 6:
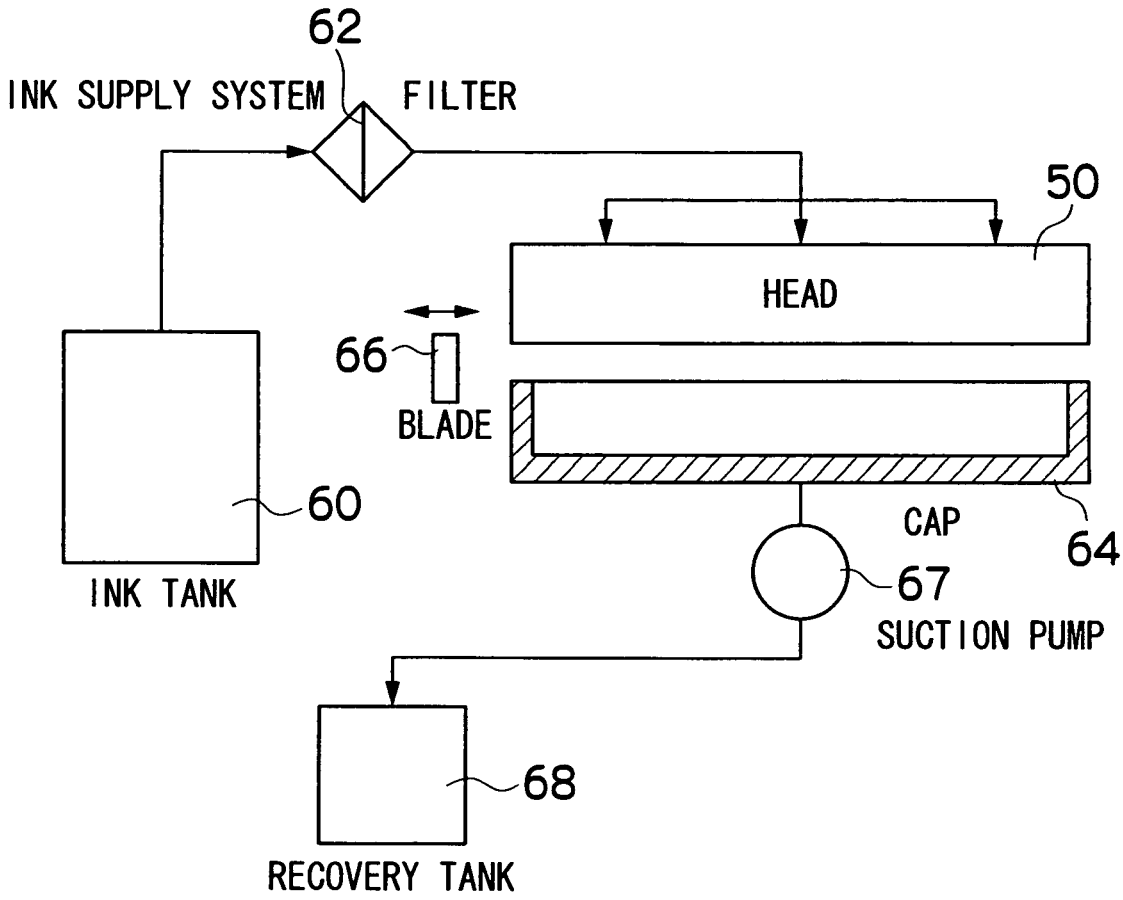
FIG. 6 is a block diagram showing the approximate composition of an ink supply system of the inkjet recording apparatus shown in FIG. 1.

FIG. 6 is a schematic drawing showing the configuration of an ink supply system in the inkjet recording apparatus 10.

The ink supply tank 60 is a base tank that supplies ink and is set in the ink storing and loading unit 14 described above with reference to FIG. 1. The aspects of the ink supply tank 60 include a refillable type and a cartridge type: when the remaining amount of ink is low, the ink supply tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and air bubbles is disposed between the ink supply tank 60 and a head 50 as shown in FIG. 6. Preferably, the filter mesh size is not greater than the diameter of the nozzle and commonly about 20 μm.

Although not shown in FIG. 6, it is preferable to provide a sub-tank integrally to the head 50 or nearby the head 50. The sub-tank has a damper function for preventing variation in the internal pressure of the head and a function for improving refilling of the head.

The inkjet recording apparatus 10 is also provided with a cap 64 as a device to prevent the nozzles 51 from drying out or to prevent increase in the ink viscosity in the vicinity of the nozzles, and a cleaning blade 66 as a device to clean the nozzle face.

A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power is turned OFF or when the inkjet recording apparatus 10 is in a print standby state, the cap 64 is raised to a predetermined elevated position so as to come into close contact with the head 50, and the nozzle face is thereby covered with the cap 64.

In a case where the use frequency of a particular nozzle 51 is low and a state of not ejecting ink continues for a prescribed time period or more during printing or standby, the solvent of the ink in the vicinity of the nozzle evaporates and the viscosity of the ink increases. In this situation, it is difficult to eject ink from the particular nozzle 51 even if the piezoelectric actuator 58 is operated.

Therefore, before a situation of this kind develops (i.e., while the viscosity of ink is within a range of viscosity where ink can be ejected by operation of the piezoelectric actuator 58), the piezoelectric actuator 58 is operated in such a manner that a preliminary ejection ("purge", "blank ejection", "liquid ejection" or "dummy ejection") is carried out toward the cap 64 (ink receptacle), in order to expel the degraded ink (i.e., the ink having increased viscosity in the vicinity of the nozzle).

Furthermore, in a case where air bubbles enter into the ink inside the head 50 (inside the pressure chamber 52), even if the piezoelectric actuator 58 is operated, it is difficult to eject ink from the nozzle. In the this case, the cap 64 is placed on the head 50, the ink (ink containing air bubbles) inside the pressure chamber 52 is then removed by suction by means of a suction pump 67, and the ink removed by the suction is supplied to a recovery tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chambers 52, the ink consumption is considerably large. Therefore, preferably, preliminary ejection is carried out when the increase in the viscosity of the ink is still minor.

The cleaning blade 66 is composed of rubber or another elastic member, and can slide on the ink ejection surface (surface of the nozzle plate) of the head 50 by means of a blade movement mechanism (a wiper) which is not shown in drawings. When ink droplets or foreign matter has adhered to the nozzle plate, the surface of the nozzle plate is wiped and cleaned by sliding the cleaning blade 66 on the nozzle plate. When the ink ejection surface is cleaned by the blade mechanism, the preliminary ejection described above is performed in order to prevent foreign matters from entering a nozzle 51 due to the blade.

Description of Control System

FIG. 7 is a principal block diagram showing a system configuration of the inkjet recording apparatus 10. The inkjet recording apparatus 10 comprises a communications interface 70, a system controller 72, a memory 74, a motor driver 76, a heater driver 78, a print controller 80, an image buffer memory 82, a head driver 84, and a signal processing unit 85, and the like.

The communications interface 70 is an interface unit for receiving image data sent from a host computer 86. A serial interface such as USB (universal serial bus), IEEE1394, Ethernet (registered trademark), wireless network, or a parallel interface such as a Centronics interface may be used as the communications interface 70. A buffer memory (not shown) may be mounted in this portion in order to increase the communications speed. The image data sent from the host computer 86 is received by the inkjet recording apparatus 10 through the communications interface 70, and is temporarily stored in the memory 74.

The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with prescribed programs, as well as a calculation device for performing various calculations. More specifically, the system controller 72 controls the various sections, such as the communications interface 70, memory 74, motor driver 76, heater driver 78, and the like, as well as controlling communications with the host computer 86 and writing and reading to and from the memory 74, and it also generates control signals for controlling motors such as the motor 88 for of the conveyance system and heaters such as the heater 89 for the post drying unit 42.

Programs executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

The motor driver 76 is a driver (drive circuit) which drives the motor 88 in accordance with instructions from the system controller 72. Furthermore, the heater driver 78 is a driver which drives the heater 89 such as the temperature adjustment heater in the post drying unit 42, the inkjet recording apparatus 10 and the head 50, and the like, in accordance with instructions from the system controller 72.

The print controller 80 has a signal processing function for performing various tasks, such as correction processing and other types of processing for generating print control signals from the image data stored in the memory 74 in accordance with commands from the system controller 72, and the print controller 80 supplies the generated print data (dot data) to the head driver 84. Prescribed signal processing is carried out in the print controller 80, and the ejection amount and the ejection timing of the ink droplets from the each of heads 50 are controlled via the head driver 84, on the basis of the print data. By this means, desired dot size and dot positions are achieved.

The print controller 80 is provided with the image buffer memory 82; and image data, parameters, and other data are temporarily stored in the image buffer memory 82 when image data is processed in the print controller 80. Also possible is an aspect in which the print controller 80 and the system controller 72 are integrated to form a single processor.

The head driver 84 drives the piezoelectric actuators 58 of the heads of the respective colors, 12K, 12C, 12M and 12Y, on the basis of print data supplied by the print control unit 80. In other words, in the head driver 84, drive signals to be supplied to the piezoelectric actuators 58 are generated on the basis of the dot data obtained from the print controller 80, and the drive signals are supplied to the respective piezoelectric actuators 58 via the prescribed circuitry and wiring. In order to maintain uniform driving conditions in each head, a feedback control system may also be incorporated into the head driver 84.

The image data to be printed is externally inputted through the communications interface 70, and is stored in the memory 74. In this stage, the RGB image data is stored in the memory 74.

The image data stored in the memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y The dot data generated by the print controller 80 is stored in the image buffer memory 82.

The head driver 84 generates drive control signals for the head 50 on the basis of the dot data stored in the image buffer memory 82. By supplying the drive control signals generated by the head driver 84 to each head 50, the ink is ejected from each head 50. By controlling the ink ejection from each head 50 in synchronization with the conveyance velocity of the recording paper 16, an image is formed on the recording paper 16.

The signal processing unit 85 is a signal processing block which carries out prescribed signal processing on the pressure determination signals obtained from the pressure sensors 59 in accordance with the pressure in the pressure chambers 52 as shown in FIG. 4, extracts an ejection abnormality factor, and supplies the extraction results to the print controller.

The required maintenance processing is determined on the basis of the extraction results for the ejection abnormality factors obtained by the signal processing unit 85. This determination of the maintenance processing may be carried out by the signal processing unit 85, or it may be carried out by the print controller 80 or the system controller 72.

If an ejection abnormality state is determined, then the print controller 80 or the system controller 72 activates a cap movement mechanism (not shown) in such a manner that the cap 64 shown in FIG. 6 is placed in tight contact with the nozzle forming surface of the head 50, whereupon maintenance processing (e.g., suctioning, purging, wiping, or the like) suited to the ejection abnormality factor is carried out. In other words, the print controller 80 or the system controller 72 shown in FIG. 7 functions as a device for controlling maintenance processing.

A detailed description of the signal processing unit 85 and the ejection abnormality factor extraction processing is described later.

Various control programs are stored in the program storage unit 90 shown in FIG. 7, and the control program is read out and executed in accordance with commands from the system controller 72. For the program storage unit 90, a semiconductor memory such as a ROM or EEPROM, or a magnetic disk, or the like, may be used. The program storage unit 90 may be provided with an external interface, and a memory card or PC card may also be used as the program storage unit 90. Furthermore, of such storage media, various types of storage media may also be provided in combination. The program storage unit 90 may also function as a storage device (not shown) for storing operational parameters, and the like.

In the present embodiment, the system controller 72, the memory 74, the print controller 80, and the like, are depicted as separate functional blocks, but they may also be integrated to form one single processor. Furthermore, it is also possible to achieve a portion of the functions of the system controller 72 and a portion of the functions of the print controller 80, by one processor.

Figure 8:
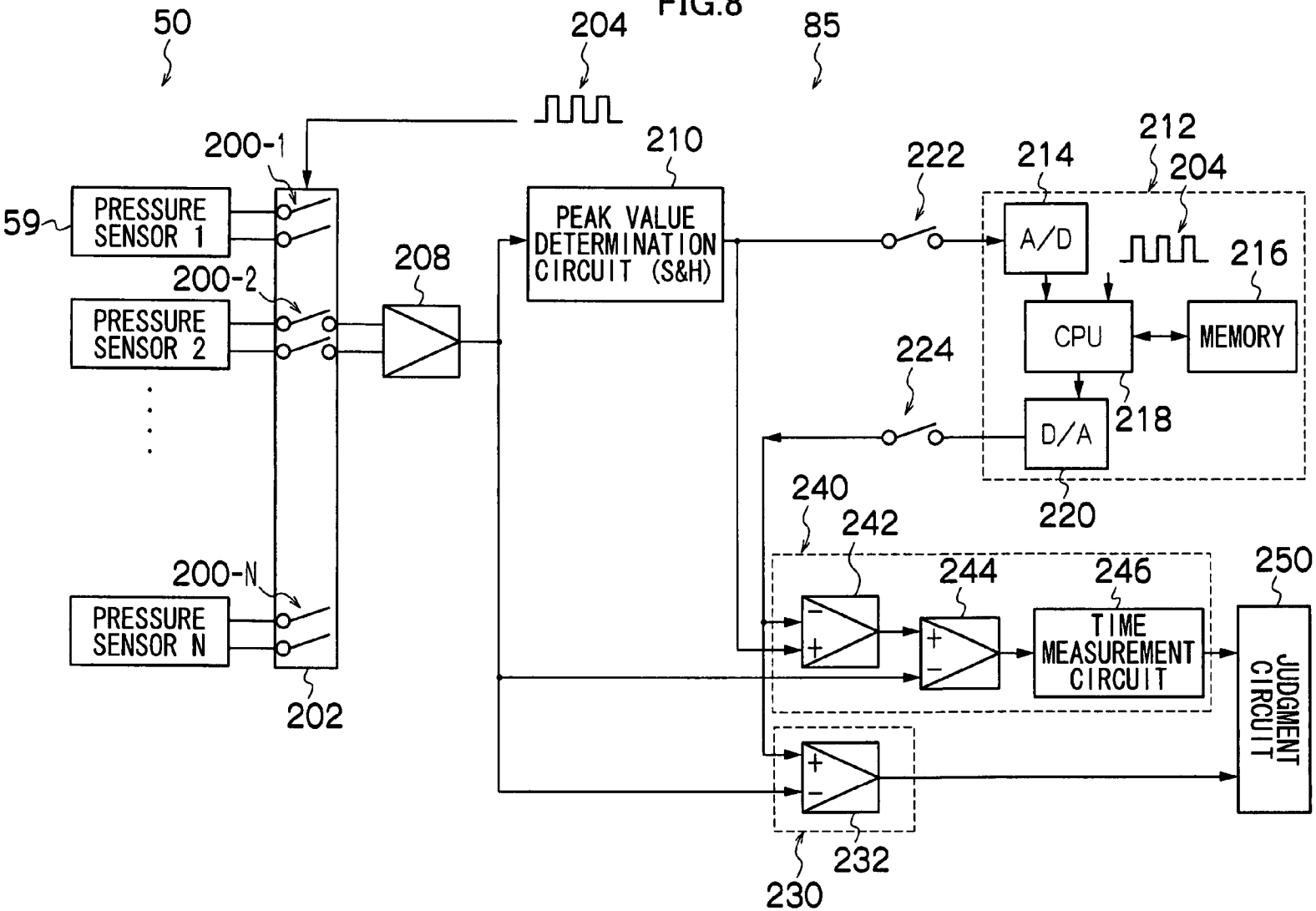
FIG. 8 is a block diagram showing the internal composition of the signal processing unit shown in FIG. 7.

Next, the signal processing unit 85 shown in FIG. 7 is described. FIG. 8 is a block diagram showing a composition of the signal processing unit 85.

In FIG. 8, the signal processing unit 85 comprises: a switch array (switch circuit) 202 including switching elements 200 (200-1 to 200-N) corresponding to the pressure sensors 59 (pressure sensor 1 to pressure sensor N); a charge amplifier (amplification circuit) 208 which amplifies pressure determination signals obtained from the pressure sensors 59 via the switch array 202, on the basis of a prescribed gain; a peak value determination circuit 210 which determines the peak values of the pressure determination signals amplified by the charge amplifier 208; and a storage circuit 212 which stores the peak values determined by the peak value determination circuit 210.

Opening and closing (on and off switching) of the switching elements 200 of the switch array 202 is controlled on the basis of synchronization signals 204. In other words, the switch array 202 functions as a device for selecting the pressure sensors 59 from which a pressure determination signal is to be acquired from, on the basis of the synchronization signals 204.

The peak value determination circuit 210 determines the peak value of an analog pressure determination signal. For the peak value determination circuit 210, it is suitable to use a sample and hold circuit (S&H).

The storage circuit 212 comprises: an A/D converter (A/D conversion circuit) 214 which converts the peak values determined by the peak value determination circuit 210 from analog data into digital data; a CPU 218 which stores the peak values of the digital data in a memory 216, on the basis of the synchronization signals 204 supplied to the switch array 202; and a D/A converter (D/A conversion circuit) 220 which converts the peak values read out from the memory 216 via the CPU 218 from digital data into an analog signal (data).

The CPU 218 used for the storage circuit 212 functions as a memory controller which controls the writing of data to the memory 216 and the read out of data from the memory 216.

The storage circuit 212 having this composition functions as a device for storing the peak value of a pressure determination signal (in the present embodiment, the peak value of an output signal of the charge amplifier 208) in a state of normal ejection of the liquid.

The CPU 218 may also be combined with a processor which constitutes the system controller 72 or the print controller 80 shown in FIG. 7. Moreover, the memory 216 may also be combined with another memory, such as the memory 74 or the image buffer memory 82 shown in FIG. 7.

Further, the signal processing unit 85 includes a first ejection abnormality factor extraction unit 230, a second ejection abnormality factor extraction unit 240, and a judgment circuit 250 which determines maintenance processing corresponding to the ejection abnormality factors extracted by the first ejection abnormality factor extraction unit 230 and the second ejection abnormality factor extraction unit 240.

The first ejection abnormality factor extraction unit 230 extracts an ejection abnormality factor such as increased ink viscosity (which is also, hereinafter, referred to as "first ejection abnormality factor"), according to the comparison between the pressure determination signal (the output signal of the charge amplifier 208) obtained from the pressure sensor 59 during a prescribed ejection abnormality determination period, and a reference peak value (the peak value of the pressure determination signal in the normal ejection state) stored in the storage circuit 212. The first ejection abnormality factor extraction unit 230 outputs the extraction result (i.e., the first determination signal) to the judgment circuit 250. In general, in a case where the ejection abnormality due to increased ink viscosity has occurred, a first determination signal output from the first ejection abnormality factor extraction unit 230 has a higher amplitude than the pressure determination signal in the normal ejection state.

The first ejection abnormality factor extraction unit 230 according to the present embodiment comprises a comparator 232. The first ejection abnormality factor extraction unit 230 compares the voltage value of a pressure determination signal obtained from a pressure sensor 59 during image formation (in an on-line state), with a reference peak value which is determined and stored in the memory 216 when image formation is not being performed (in an off-line state). If the voltage value of the pressure determination signal is greater than the reference peak value, then an "H level signal" which indicates that increased viscosity of the ink has occurred is output. On the other hand, if the level of the pressure determination signal is not greater than the reference peak value, then an "L level signal" is output.

The second ejection abnormality factor extraction unit 240 extracts an ejection abnormality factor such as an air bubble or paper dust (which is also, hereinafter, referred to as "second ejection abnormality factor") according to the comparison with a pressure determination signal obtained during the normal ink ejection (normal liquid ejection). Then the second ejection abnormality factor extraction unit 240 sends the extraction result (the second determination signal) to the judgment circuit 250. In general, in a case where the ejection abnormality due to an air bubble or paper dust, or the like, has occurred, a second determination signal output from the second ejection abnormality factor extraction unit 240 has an amplitude not greater than the pressure determination signal for normal ejection but has an abnormal frequency.

The second ejection abnormality factor extraction unit 240 includes a threshold value variable setting circuit 242, a measurement pulse generation circuit 244, and a time measurement circuit 246.

The threshold value variable setting circuit 242 extracts the differential between the peak value of the pressure determination signal (i.e., the output signal from the peak value determination circuit 210) obtained from a pressure sensor 59 during the prescribed ejection abnormality determination period and the reference peak value (i.e., the peak value of the pressure determination signal in the normal ejection state) stored in the storage circuit 212. On the basis of the differential thus extracted, the threshold value variable setting circuit 242 variably sets a threshold value to be used for creating pulses (which is, hereinafter, referred to as "measurement pulses") which enables an ejection abnormality to be identified according to the time interval. More specifically, if the peak value of the pressure determination signal is equal to the reference peak value, in other words, if the ejection is performed in an ideal normal state, then a reference threshold value corresponding to the reference peak value is output. On the other hand, if the peak value of the pressure determination signal is different to the reference peak value, then the reference threshold value is changed to a threshold value for creating a measurement pulse and then output. The threshold value set by this threshold value variable setting circuit 242 is also hereinafter referred to as the "variable threshold value".

The threshold value variable setting circuit 242 according to the present embodiment comprises an operational amplifier (differential amplifier), and it outputs, as the variable threshold value, the differential between the peak value of the pressure determination signal determined during image formation (in an on-line state) and the reference peak value which is determined and stored in the memory 216 when image formation is not being performed (in an off-line state).

In the present embodiment, the reference threshold value is set to 0V, in other words, no reference threshold value is provided. More specifically, in the ideal normal ejection state, since the differential between the peak value of the pressure determination signal and the reference peak value is 0V, then this value (0V) is directly output from the threshold value variable setting circuit 242 as a variable threshold value. By adopting a composition of this kind in which no reference threshold value is provided (in other words, by setting the reference threshold value to 0V), the composition and processing of the signal processing unit 85 are simplified.

The measurement pulse generation circuit 244 generates a measurement pulse which enables to identify an ejection abnormality factor according to the time interval, on the basis of the pressure determination signal obtained from a pressure sensor 59 during the prescribed ejection abnormality determination period (in the present embodiment, the output signal from the charge amplifier 208), and the variable threshold value output from the threshold value variable setting circuit 242.

The measurement pulse generation circuit 244 according to the present embodiment comprises a comparator. The measurement pulse generation circuit 244 compares the voltage value of a pressure determination signal determined during image formation (in an on-line state) with the variable threshold value, and accordingly outputs square measurement pulses, which have a value of a level H while the voltage value of the pressure determination signal is higher than the variable threshold value and have a value of a level L while the voltage value of the pressure determination signal is not greater than the threshold value.

The time measurement circuit 246 measures a time interval of the measurement pulses generated by the measurement pulse generation circuit 244, and it outputs this measurement result as a second determination signal. In other words, the time measurement circuit 246 identifies the frequency of the pressure determination signal by measuring a time interval of the measurement pulses.

The time measurement circuit 244 according to the present embodiment is constituted by a counter.

The judgment circuit 250 identifies the presence or absence of ejection abnormalities, and the ejection abnormality factors, on the basis of the first determination signal output from the first ejection abnormality factor extraction unit 230 and the second determination signal output from the second ejection abnormality factor extraction unit 240. If an ejection abnormality has occurred, the judgment circuit 250 also determines maintenance processing suited to the factor of the ejection abnormality.

Although the judgment circuit 250 described above is included in the signal processing unit 85, the judgment circuit 250 may also be composed as a part of the print controller 80 shown in FIG. 7, or as a part of the system controller 72 shown in FIG. 7. In the composition shown in FIG. 8, the determination results of the judgment circuit 250 are sent to the print controller 80 in FIG. 7, and the print controller 80 controls the execution of maintenance processing accordingly. For example, in a composition where the judgment circuit 250 is included in the print controller 80, the extraction results of the first ejection abnormality factor extraction unit 230 and the second ejection abnormality factor extraction unit 240 are sent to the print controller 80.

Furthermore, the signal processing unit 85 comprises a first switch 222 which opens or closes the circuit between the peak value determination circuit 210 and the storage circuit 212, and a second switch 224 which opens or closes the circuit between the storage circuit 212 and the first ejection abnormality factor extraction unit 230 and second ejection abnormality factor extraction unit 240.

When a peak value output from the peak value determination circuit 210 is written to the memory 216 of the storage circuit 212, the first switch 222 is closed and the second switch 224 is opened. When a peak value stored in the memory 216 of the storage circuit 212 is read out and input to the first ejection abnormality factor extraction unit 230 and the second ejection abnormality factor extraction unit 240, then the first switch 222 is opened and the second switch 224 is closed.

Next, the relationship between a waveform of the pressure determination signal obtained from a pressure sensor 59 and an ejection abnormality factor is described.

Figure 9A:
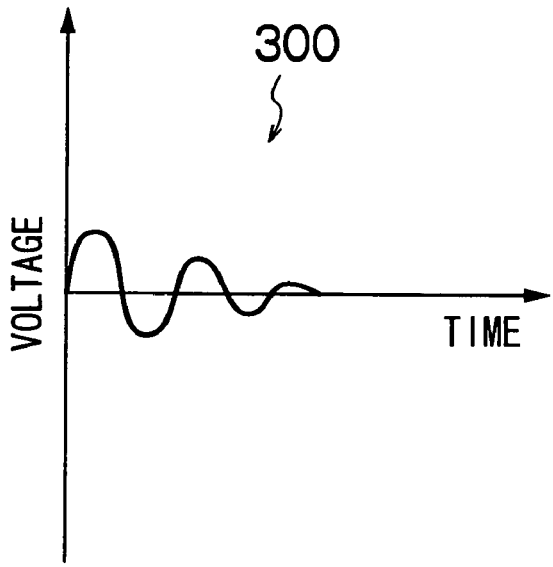
FIGS. 9A and 9B are waveform diagrams showing pressure determination signals obtained from a pressure sensor.
Figure 9B:
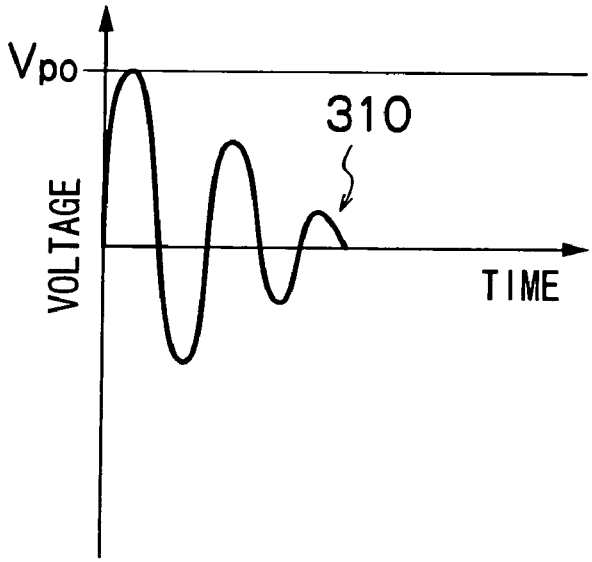

FIG. 9A is a diagram showing a pressure determination signal 300 which is output from a pressure sensor 59 and is to be input to the charge amplifier 208 via the switching array 202. This pressure determination signal 300 obtained from the pressure sensor 59 has a voltage directly proportional to the pressure inside the pressure chamber 52. FIG. 9B is a diagram showing a pressure determination signal 310 which has been amplified by the charge amplifier 208 and is to be input to the peak value determination circuit 210, and the peak value $V_{p0}$ of that pressure determination signal 310 (in other words, the output signal of the peak value determination circuit 210). In a case where the pressure sensors 59 have good sensitivity (in other words, in a case where the pressure determination signals 300 output from the pressure sensors 59 each have a voltage which can be recognized as a signal by the subsequent circuitry), the charge amplifier 208 is not necessary.

The pressure determination signal in the abnormal ejection state has a different amplitude and/or a different frequency from the pressure determination signal in the normal ejection state.

Figure 10A:
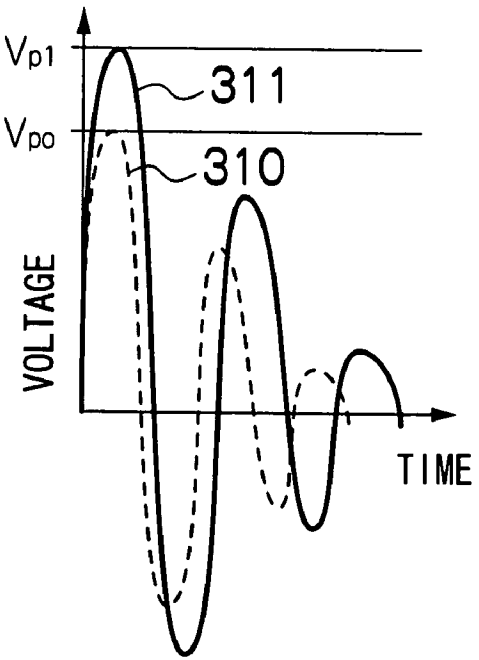
FIGS. 10A to 10C are waveform diagrams showing a comparison between a pressure determination signal in a normal ejection state and a pressure determination signal in an abnormal ejection state.

FIG. 10A is a diagram showing a pressure determination signal 310 in a case where the pressure inside a pressure chamber 52 is normal and the ejection is normal, and a pressure determination signal 311 in a case where the ejection abnormality has occurred due to increased viscosity of the ink. Compared with the peak value $V_{p0}$ of the normal pressure determination signal 310, the peak value $V_{p1}$ of the pressure determination signal 311 in the case of increased ink viscosity is higher. Moreover, compared with the normal pressure determination signal 310, the pressure determination signal 311 in the case of increased ink viscosity has a lower frequency.

Figure 10B:
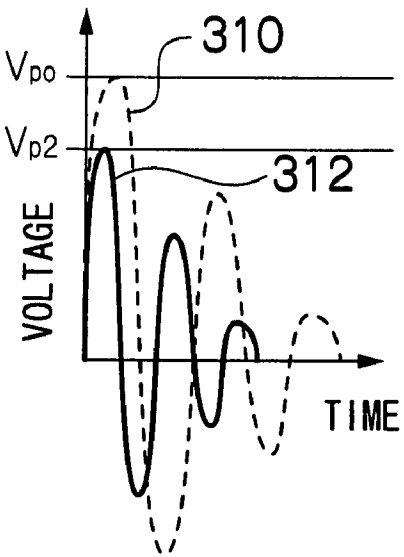

FIG. 10B is a diagram showing the normal pressure determination signal 310 and a pressure determination signal 312 in a case where an ejection abnormality has occurred due to the presence of an air bubble. Compared with the peak value $V_{p0}$ of the normal pressure determination signal 310, the peak value $V_{p2}$ of the pressure determination signal 312 in the case of an air bubble is lower. Moreover, compared with the normal pressure determination signal 310, the pressure determination signal 312 in the case of an air bubble has a higher frequency.

Figure 10C:
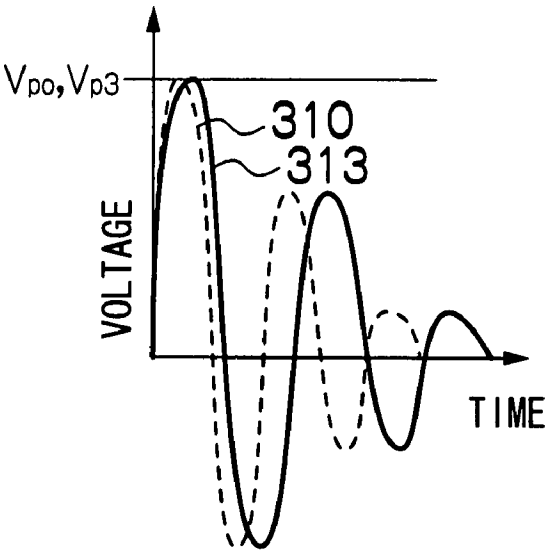

FIG. 10C is a diagram showing the normal pressure determination signal 310 and a pressure determination signal 313 in a case where an ejection abnormality has occurred due to adherence of paper dust. Compared with the peak value $V_{p0}$ of the normal pressure determination signal 310, the peak value $V_{p3}$ of the pressure determination signal 313 in the case of adherence of paper dust is the same, or slightly lower. Moreover, compared with the normal pressure determination signal 310, the pressure determination signal 313 in the case of adherence of paper dust has a lower frequency.

Next, the operation of the first ejection abnormality factor extraction circuit 230 and the second ejection abnormality factor extraction unit 240 is described with reference to FIGS. 11A to 15C.

Firstly, the operation of the first ejection abnormality factor extraction unit 230 is described.

Figure 11A:
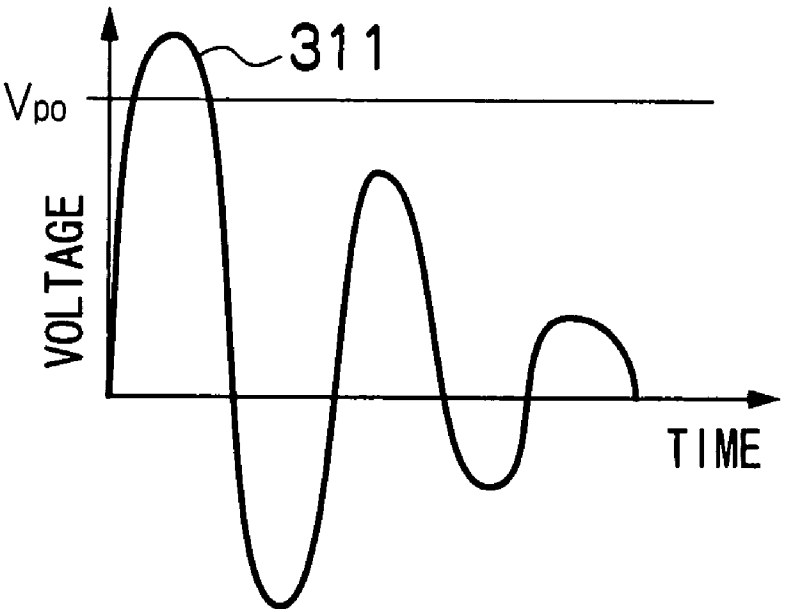
FIGS. 11A and 11B are waveform diagrams showing the operation of a first ejection abnormality factor extraction unit in a case where an ejection abnormality caused by increased ink viscosity has occurred.
Figure 11B:
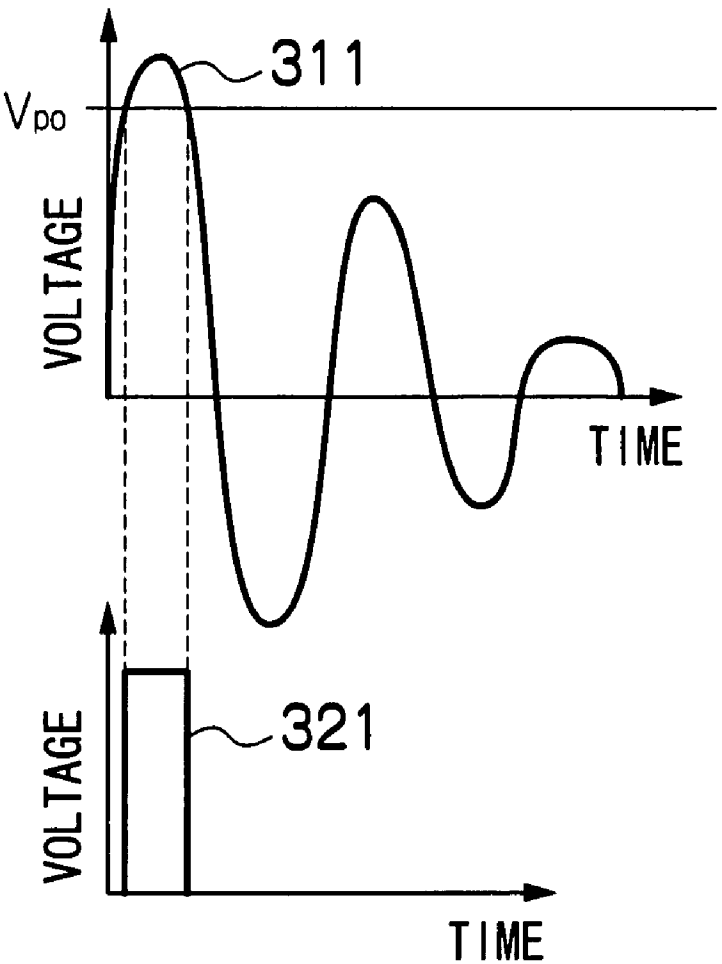

In a state of increased viscosity of the ink, when the pressure determination signal 311 shown in FIG. 11A and the reference peak value $V_{p0}$ are input to the comparator 232 of the first ejection abnormality factor extraction unit 230, then as shown in FIG. 11B, the comparator 232 compares the pressure determination signal 311 and the reference peak value $V_{p0}$, and it outputs an H level signal during the time period that the pressure determination signal 311 is higher than the reference peak value $V_{p0}$. In a state of increased ink viscosity, the pressure determination signal 311 is higher than the reference peak value $V_{p0}$, and therefore a square pulse 321 is output from the comparator 232 as the extraction result for the first ejection abnormality factor.

Figure 12B:
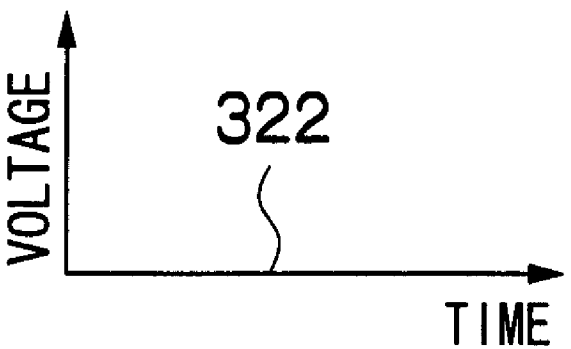
FIGS. 12A and 12B are waveform diagrams showing the operation of the first ejection abnormality factor extraction unit in a case where an ejection abnormality caused by increased ink viscosity has not occurred.
Figure 12A:
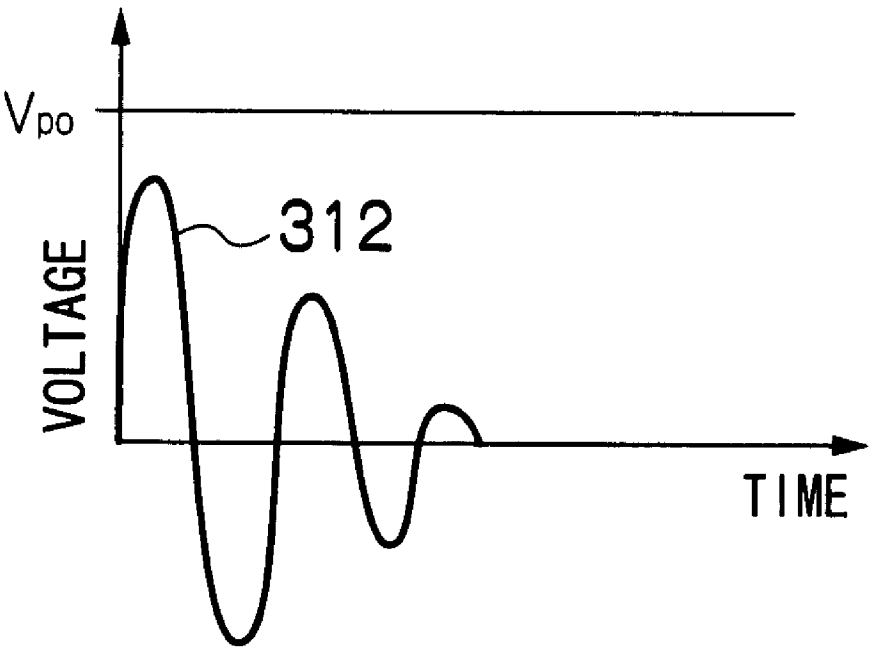

In a state where an air bubble is present in the ink in the pressure chamber 52, when the pressure determination signal 312 shown in FIG. 12A and the reference peak value $V_{p0}$ are input to the comparator 232 of the first ejection abnormality factor extraction unit 230, then the comparator 232 compares the pressure determination signal 312 and the reference peak value $V_{p0}$, as shown in FIG. 12B. In a state where the air bubble is present, since the pressure determination signal 312 is lower than the reference peak value $V_{p0}$, then a flat signal 322 without any pulses is output from the comparator 232.

In a state where paper dust is adhering to the nozzles 51 or in a normal ejection state, similarly to a case where an air bubble has occurred, a flat signal without any pulses is output from the comparator 232, as shown in FIG. 12B.

Next, the operation of the second ejection abnormality factor extraction unit 240 is described.

Figure 13A:
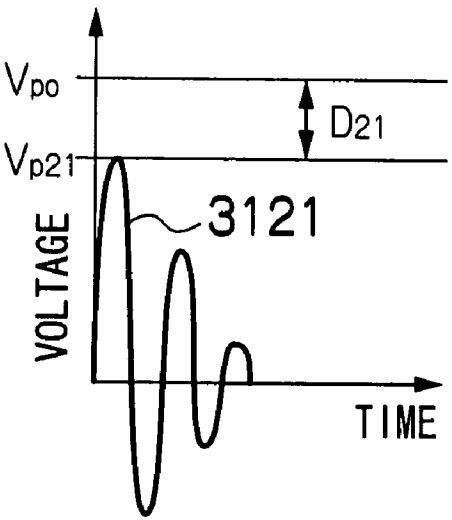
FIGS. 13A to 13C are waveform diagrams showing the operation of a second ejection abnormality factor extraction unit in a case where an ejection abnormality caused by a medium or small-sized air bubble has occurred.
Figure 13B:
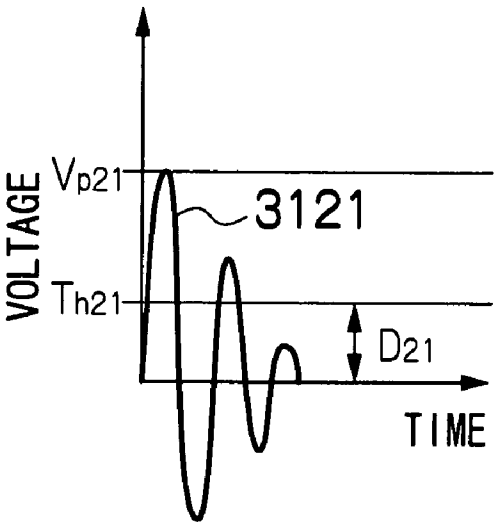
Figure 13C:
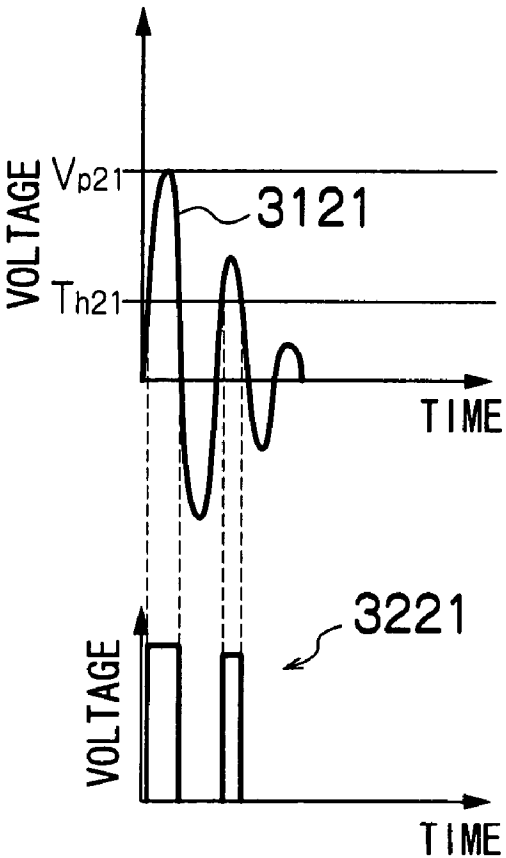

In a state where a medium or small-sized air bubble is present in the ink inside a pressure chamber 52, when the pressure determination signal 3121 shown in FIG. 13A is input to the peak value determination circuit 210, and the peak value $V_{p21}$ of the pressure determination signal 3121 shown in FIG. 13A and the reference peak value $V_{p0}$ are input to the threshold value variable setting circuit 242, then the threshold value variable setting circuit 242 extracts the differential $D_{21}$ between the peak value $V_{p21}$ of the pressure determination signal 3121 and the reference peak value $V_{p0}$, and it sets the threshold value $Th_{21}$ in the measurement pulse generation circuit 244 to the value of differential $D_{21}$, as shown in FIG. 13B (i.e., $Th_{21}=D_{21}$). The measurement pulse generation circuit 244 compares the pressure determination signal 3121 with the threshold value $Th_{21}$, as shown in FIG. 13C. In a state where the medium or small-sized air bubble is present, the threshold value $Th_{21}$ is lower than the peak value $V_{p21}$ of the pressure determination signal 3121, and hence, measurement pulses 3221 are output from the measurement pulse generation circuit 244 as an extraction result for the second ejection abnormality factor. The time interval of these measurement pulses 3221 is smaller than the vibration period of the pressure determination signal 310 in the normal ejection state.

Figure 14A:
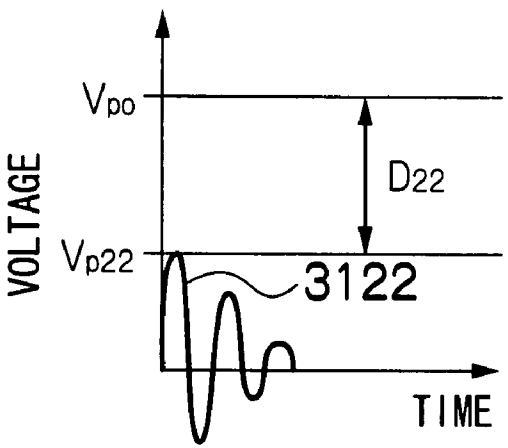
FIGS. 14A to 14C are waveform diagrams showing the operation of the second ejection abnormality factor extraction unit in a case where an ejection abnormality caused by a large-sized air bubble has occurred.
Figure 14B:
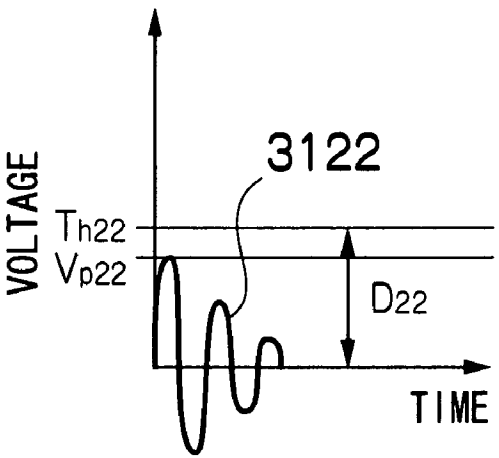
Figure 14C:
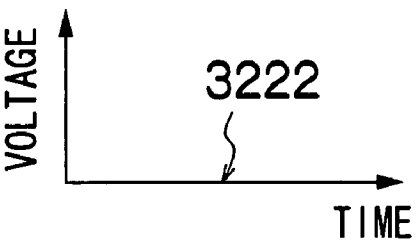

In a state where a large-sized air bubble is present in the ink in a pressure chamber 52, when the pressure determination signal 3122 shown in FIG. 14A is input to the peak value determination circuit 210, and the peak value $V_{p22}$ of the pressure determination signal 3122 shown in FIG. 14A and the reference peak value $V_{p0}$ are input to the threshold value variable setting circuit 242, then the threshold value variable setting circuit 242 extracts the differential $D_{22}$ between the peak value $V_{p22}$ of the pressure determination signal 3122 and the reference peak value $V_{p0}$, and it sets the threshold value $Th_{22}$ in the measurement pulse generation circuit 244 to the differential $D_{22}$, as shown in FIG. 14B (i.e., $Th_{22}=D_{22}$). The measurement pulse generation circuit 244 compares the pressure determination signal 3122 with the threshold value $Th_{22}$, as shown in FIG. 14C. In a state where the large-sized air bubble is present, the threshold value $Th_{22}$ is larger than the peak value $V_{P22}$ of the pressure determination signal 3122, and hence, a flat signal without any pulses (in other words, a measurement pulse having an infinite pulse time interval) is output from the measurement pulse generation circuit 244 as an extraction result for the second ejection abnormality factor.

Figure 15A:
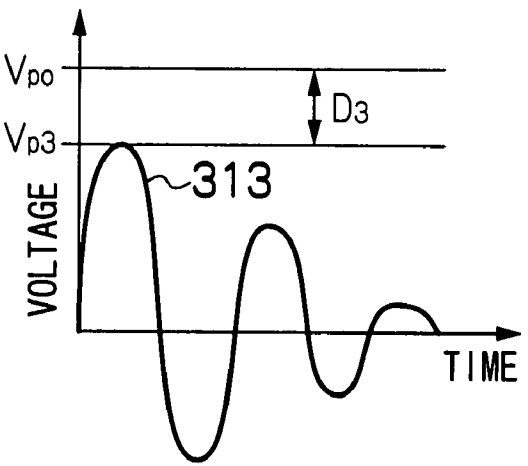
FIGS. 15A to 15C are waveform diagrams showing the operation of the second ejection abnormality factor extraction unit in a case where an ejection abnormality caused by paper dust has occurred.
Figure 15B:
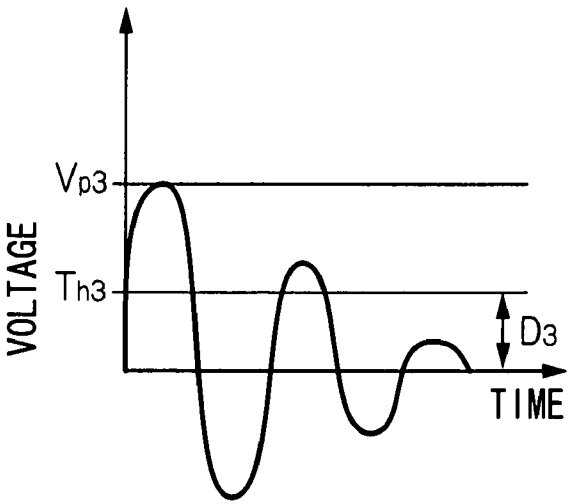
Figure 15C:
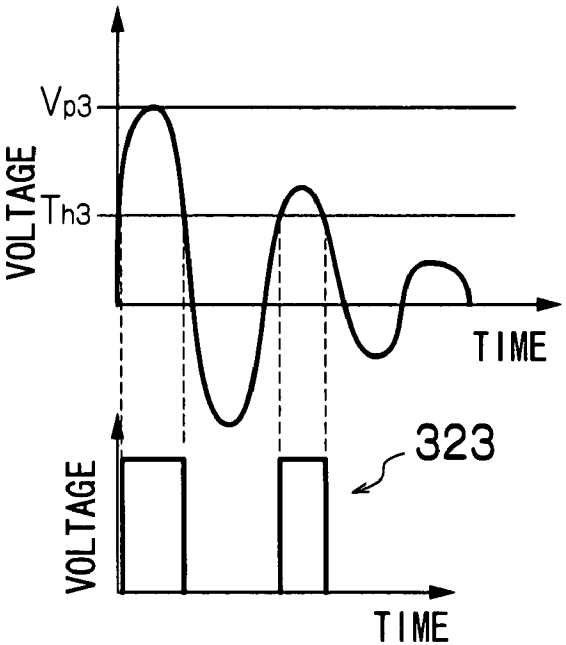

In a state where paper dust is adhering to a nozzle 51, when the pressure determination signal 313 shown in FIG. 15A is input to the peak value determination circuit 210, and the peak value $V_{p3}$ of the pressure determination signal 313 shown in FIG. 15A and the reference peak value $V_{p0}$ are input to the threshold value variable setting circuit 242, then the threshold value variable setting circuit 242 extracts the differential $D_3$ between the peak value $V_{p3}$ of the pressure determination signal 313 and the reference peak value $V_{p0}$, and it sets the threshold value $Th_3$ in the measurement pulse generation circuit 244 to the differential $D_3$, as shown in FIG. 15B (i.e., $Th_3=D_3$). The measurement pulse generation circuit 244 compares the pressure determination signal 313 with the threshold value $Th_3$, as shown in FIG. 15C. In a state where the paper dust is adhering to the nozzle 51, the threshold value $Th_3$ is lower than the peak value $V_{p3}$ of the pressure determination signal 313, and hence, measurement pulses 323 are output from the measurement pulse generation circuit 244 as an extraction result for the second ejection abnormality factor. The time interval of these measurement pulses 313 is greater than the vibration period of the pressure determination signal 310 in the normal ejection state.

In an ideal normal ejection state where the peak value of the pressure determination signal is equal to the reference peak value $V_{p0}$, the threshold value variable setting circuit 242 sets the differential (in this case, 0V) between the reference peak value $V_{p0}$ and the peak value of the pressure determination signal as a reference threshold value, in the measurement pulse generation circuit 244. In this case, the measurement pulse generation circuit 244 generates a measurement pulse based on the reference voltage of 0V.

Figure 16:
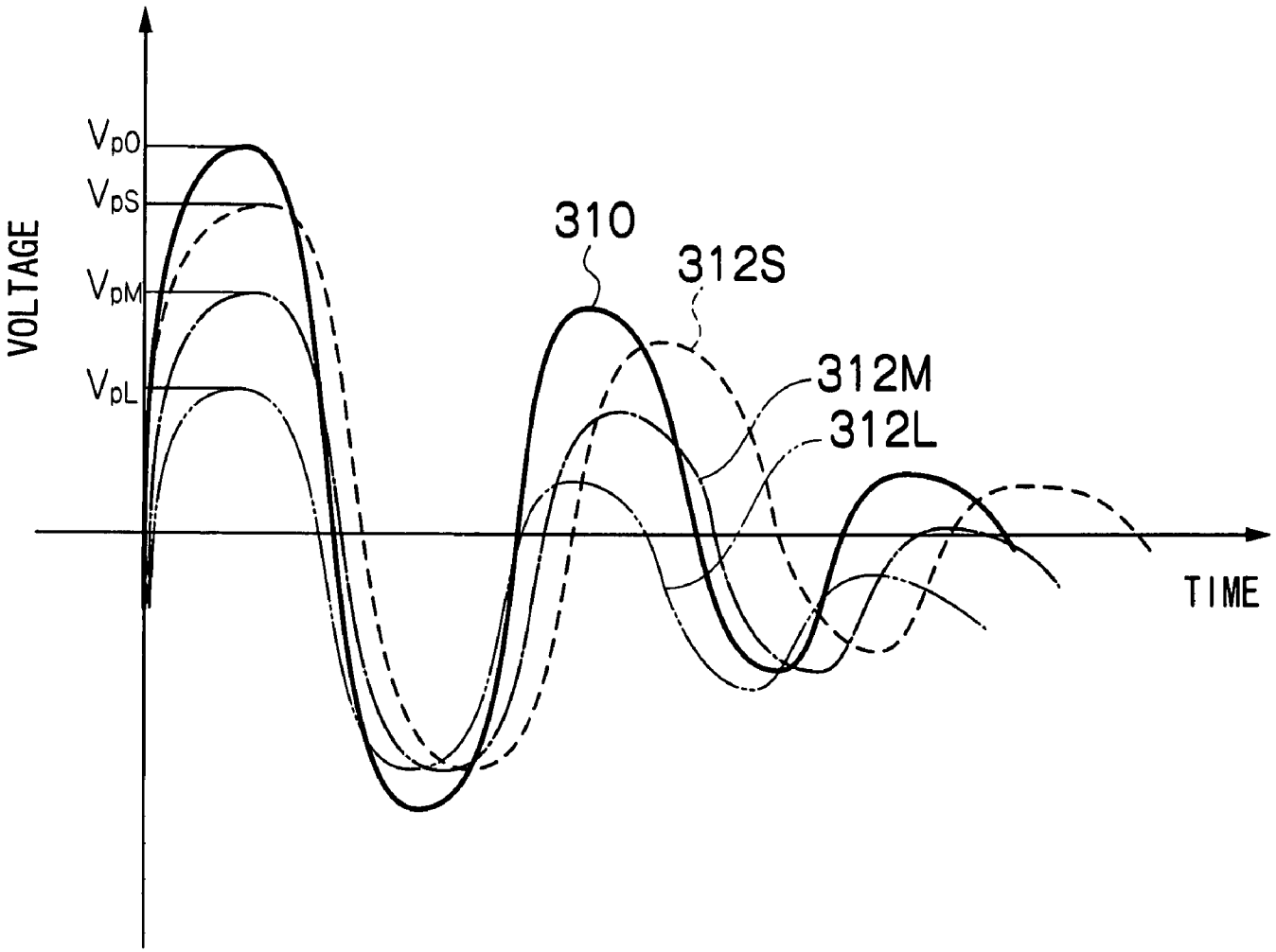
FIG. 16 is a waveform diagram showing the relationship between a pressure determination signal and each air bubble size.

FIG. 16 is a diagram showing a pressure determination signal waveform 310 in a case where no air bubble is present, a pressure determination signal 312S in a case where a small-sized air bubble (which has a diameter of 10 μm to 20 μm, in the present embodiment) is present, a pressure determination signal 312M in a case where a medium-sized air bubble (which has a diameter of 30 μm to 120 μm, in the present embodiment) is present, and a pressure determination signal 312L in a case where a large-sized air bubble (which has a diameter of 130 μm or greater, in the present embodiment) is present. In FIG. 16, only typical examples of pressure determination signals 312S, 312M and 312L corresponding to a small-sized air bubble, a medium-sized air bubble, and a large-sized air bubble are depicted.

As shown in FIG. 16, the relationship among the peak value $V_{p0}$ of the pressure determination signal 310 in a normal state, the peak value $V_{pS}$ of the pressure determination signal 312S in the event of a small-sized air bubble, the peak value $V_{pM}$ of the pressure determination signal 312M in the event of a medium-sized air bubble, and the peak value $V_{pL}$ of the pressure determination signal 312L in the event of a large-sized air bubble, is expressed as $V_{p0}>V_{pS}>V_{pM}>V_{pL}$. This relationship indicates that the larger the size of the air bubble present in a pressure chamber 52, the lower the peak value of the pressure determination signal.

Figure 17:
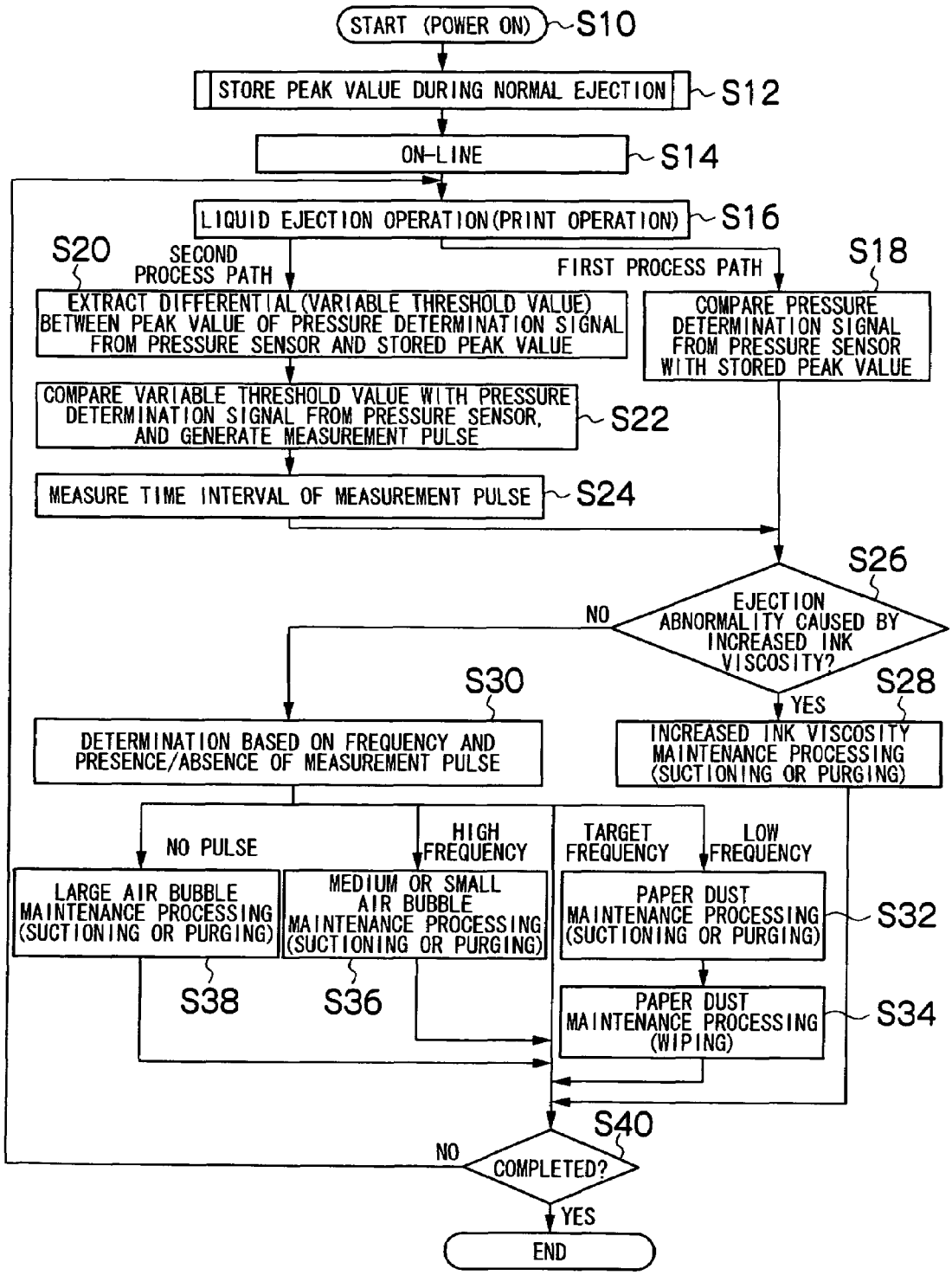
FIG. 17 is a flowchart showing a control sequence of ejection abnormality factor extraction processing.
Figure 18:
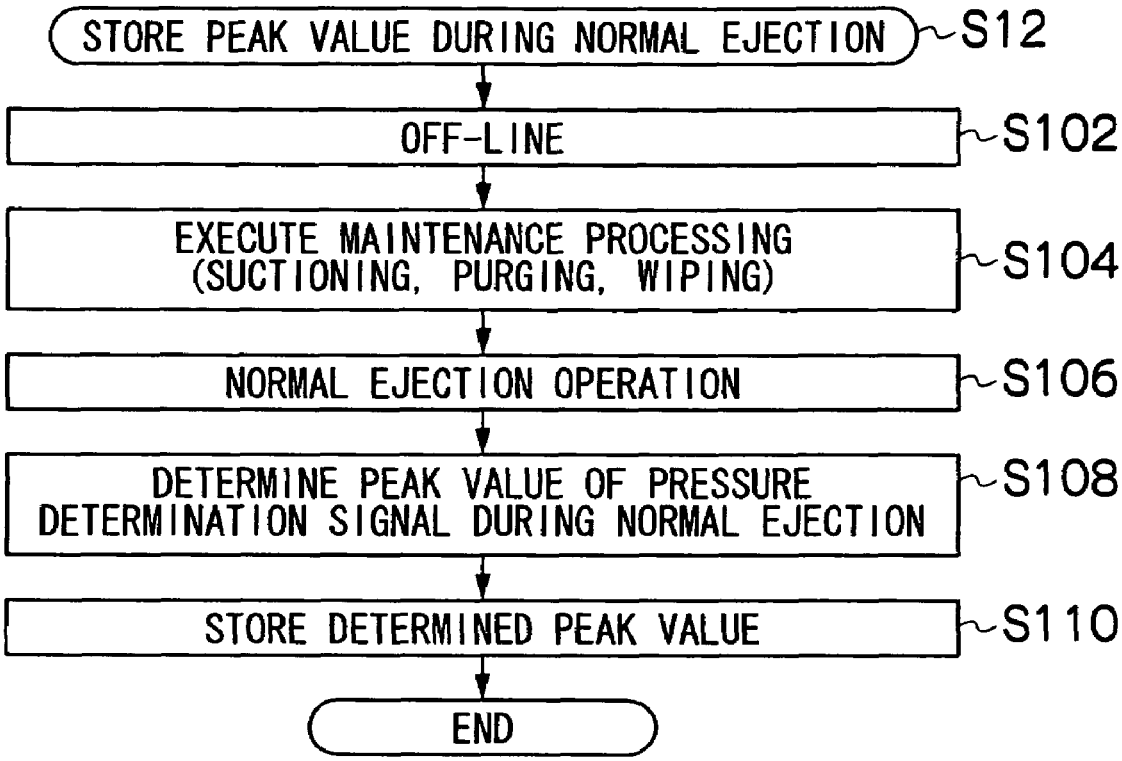
FIG. 18 is a flowchart showing a control sequence for determining the reference peak value shown in FIGS. 15A to 15C.

FIGS. 17 and 18 are flowcharts showing a sequence of an example of the ejection abnormality factor extraction and the maintenance processing in the inkjet recording apparatus 10.

According to the present embodiment, in an off-line state (non-printing state), the reference peak value $V_{p0}$ of the pressure determination signal is determined in the normal ejection state immediately after performing maintenance processing for initializing the state of the ink in a head 50, and this reference peak value $V_{p0}$ is stored in the memory 216 shown in FIG. 8. Furthermore, in an on-line state (printing state), an ejection abnormality factor is extracted on the basis of the reference peak value $V_{p0}$ stored in the memory 216, and a pressure determination signal obtained from a pressure sensor 59 at each ejection operation, and maintenance processing corresponding to this ejection abnormality factor is carried out.

As shown in FIG. 17, when the power supply is turned on (step S10), firstly, the peak value (reference peak value $V_{p0}$) in the normal ejection state is stored (step S12). In FIG. 18, the details of the sequence of processing in step S12 are shown.

As shown in FIG. 18, the apparatus is switched into an off-line state (step S102), and maintenance processing such as suctioning, purging, wiping, or the like, is carried out as part of the initialization processing (step S104).

In the off-line state, the first switch 222 shown in FIG. 8 is set to a closed state, thereby connecting the peak value determination circuit 210 with the storage circuit 212. On the other hand, the second switch 224 is set to an open state, thereby disconnecting the storage circuit 212 from the first ejection abnormality factor extraction unit 230 and the second ejection abnormality factor extraction unit 240.

In the off-line state described above, a normal ejection operation is carried out by driving a piezoelectric actuator 58 as shown in FIG. 4 (step S106). The peak value of the pressure determination signal obtained from the pressure sensor 59 is thus determined by the peak value determination circuit 210 (step S108), and is stored in the memory 216 of the storage circuit 212 as a reference peak value $V_{p0}$ (step S110).

In this stage, the reference peak values $V_{p0}$ are determined for all of the nozzles 51, and hence a reference peak value $V_{p0}$ is stored for each of the nozzles.

When the peak values in the normal ejection state is stored in the memory 216 in this way, then the procedure advances to step S14 in FIG. 17 and the printer is switched into an on-line state (step S14).

In the on-line state, the first switch 222 shown in FIG. 8 is set to an open state, thereby disconnecting the peak value determination circuit 210 from the storage circuit 212. On the other hand, the second switch 224 is set to a closed state, thereby connecting the storage circuit 212 with the first ejection abnormality factor extraction unit 230 and the second ejection abnormality factor extraction unit 240.

In the on-line state described above, print data is acquired and the piezoelectric actuators 58 are driven. In other words, an ejection operation (print operation) is carried out in the on-line state (step S16).

In the present embodiment, at each ejection operation in the on-line state, a first process (step S18) for extracting the first ejection abnormality factors due to increased ink viscosity, and a second process (steps S20 to S24) for extracting the second ejection abnormality factors due to the presence of an air bubble and the presence of paper dust, are carried out in parallel.

Firstly, a sequence of the first process is described in detail.

The first ejection abnormality factor extraction unit 230 shown in FIG. 8 compares the voltage value of the pressure determination signal obtained from a pressure sensor 59 in the on-line state, with the reference peak value $V_{p0}$ stored previously in the memory 216. According to the comparison, the first ejection abnormality factor extraction unit 230 outputs a first determination signal indicating whether or not the ejection abnormality due to increased ink viscosity has occurred (step S18).

In the present embodiment, the H level signal is output during a period when the voltage value of the pressure determination signal is higher than the reference peak value $V_{p0}$. On the other hand, the L level signal is output during a period when the voltage value of the pressure determination signal is not greater than the reference peak value $V_{p0}$. In other words, a pulse is obtained from the first ejection abnormality factor extraction unit 230 when an ejection abnormality due to increased ink viscosity has occurred, whereas no pulse is obtained from the first ejection abnormality factor extraction unit 230 when an ejection abnormality due to increased ink viscosity has not occurred.

Next, the sequence of the second process is described in detail.

The second ejection abnormality factor extraction unit 240 shown in FIG. 8 extracts, as a variable threshold value, the differential between the peak value of the pressure determination signal output from the peak value determination circuit 210 in the on-line state, and the reference peak value $V_{p0}$ stored previously in the memory 216 (step S20), and it generates measurement pulses by comparing this variable threshold value with the voltage value of the pressure determination signal obtained from a pressure sensor 59 in an on-line state (step S22), and measures the time interval of these measurement pulses (step S24).

In the present embodiment, for each ejection operation, during a period when the voltage value of the pressure determination signal is higher than the variable threshold value, the measurement pulse is created so as to have a value of the level H, whereas during a period when the voltage value of the pressure determination signal is not greater than the variable threshold value, the measurement pulse is created so as to have a value of the level L. The time interval of these measurement pulses thus created is measured, and is output from the second ejection abnormality factor extraction unit 240. In a case where no measurement pulse is produced, then a value is output which indicates that there is no measurement pulse, in other words, which indicates that the time interval of the measurement pulses is infinity.

Thereupon, the judgment circuit 250 shown in FIG. 8 judges whether or not maintenance processing for increased ink viscosity is necessary (step S26).

In the present embodiment, if there is a pulse output from the first ejection abnormality factor extraction unit 230, then it is judged that an ejection abnormality caused by increased ink viscosity has occurred and that maintenance processing corresponding to increased ink viscosity is required. Accordingly, suctioning or purging for resolving the state of increased ink viscosity is carried out (step S28).

If it is judged that an ejection abnormality caused by increased ink viscosity has not occurred, the judgment circuit 250 shown in FIG. 8 judges the presence or absence of an ejection abnormality caused by an air bubble and the presence or absence of an ejection abnormality caused by paper dust, according to the frequency that is characterized by the time interval of the measurement pulses created by the second ejection abnormality factor extraction unit 240, and it determines the required maintenance processing in accordance with the ejection abnormality factor (step S30).

In the present embodiment, if there is a measurement pulse created by the second ejection abnormality factor extraction unit 240 (i.e., the measurement pulse generation circuit 244) and the frequency of the pressure determination signal which is characterized by the time interval of the measurement pulses measured in the second ejection abnormality factor extraction unit 240 (i.e., the time measurement circuit 246), falls within the target range, then it is judged that maintenance processing is not required.

On the other hand, in the present embodiment, if there is a measurement pulse and the pressure determination signal has a frequency below the target range, then it is judged that an ejection abnormality caused by paper dust has occurred and that maintenance processing relating to paper dust is required. Suctioning or purging is accordingly carried out in order to remove the paper dust (step S32), and wiping of the nozzle surface of the head 50 is carried out (step S34).

Preferably, in the wiping process (step S34) for removing the adhered paper dust, wiping is carried out in accordance with the amount of paper dust. For example, the greater the amount of paper dust, the greater the number of wiping operations performed. For example, the number of wiping operations is determined in accordance with the state of the test chart.

Moreover, in the present embodiment, if there is a measurement pulse and the pressure determination signal has a frequency above the target range, then it is judged that an ejection abnormality caused by a medium or small-sized air bubble has occurred and maintenance processing corresponding to the medium or small-sized air bubble is required. Accordingly, suctioning or purging for removing the medium or small-sized bubble is carried out (step S36).

Further, in the present embodiment, if there is no measurement pulse, then it is judged that maintenance processing is required for a large-sized air bubble, and hence suctioning or purging for removing the large-sized air bubble is carried out (step S38).

In the maintenance processing corresponding to the occurrence of an air bubble (steps S36 and S38), a purging time is set in accordance with the size of an air bubble. More specifically, when removing an air bubble of a large size, the purging time is set to a longer time than when removing a medium-size air bubble. By controlling and altering the maintenance time in accordance with the size of the air bubble in this way, it is possible to shorten the required maintenance time in comparison with maintenance control that is carried out simply on the basis of time management or print intervals.

Thereupon, the procedure advances to step S40 where it is judged whether or not a subsequent pressure determination signal has been obtained. If no subsequent pressure determination signal has been obtained (NO verdict), then the current ejection abnormality factor extraction and maintenance determination processing is terminated. On the other hand, if a subsequent pressure determination signal has been obtained (YES verdict), then the procedure returns to step S16.

Moreover, when the operating environment of the head 50 has changed, the processing for acquiring for the reference peak value shown in FIG. 18 is carried out, and the memory 216 in FIG. 8 is rewritten. A case where the operating environment of the head 50 has changed is, for example, a case where the temperature or humidity conditions, or the like, are out of a prescribed range, or a case where the type of ink used is changed (when the ink is filled).

The present invention is not limited to the embodiments described in the present specification or shown in the drawings, and various design modifications and improvements may of course be implemented without departing from the scope of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head including a nozzle which ejects liquid, a pressure chamber which is connected to the nozzle and is to be filled with the liquid, a pressure generating element which pressurizes the liquid in the pressure chamber, and a pressure determination element which determines a pressure inside the pressure chamber and outputs a pressure determination signal;

a storage device which stores a peak value of the pressure determination signal output by the pressure determination element in a state where the nozzle ejects the liquid normally;

a first ejection abnormality factor extraction device which extracts a first ejection abnormality factor by comparing the peak value stored previously in the storage device with the pressure determination signal output by the pressure determination element during a prescribed period for ejection abnormality determination;

a threshold value variably setting device which sets a threshold value for extracting a second ejection abnormality factor according to a differential between the peak value stored previously in the storage device and a peak value of the pressure determination signal output by the pressure determination element during the prescribed period for ejection abnormality determination;

a pulse generation device which is capable of generating pulses according to a comparison result between the threshold value set by the threshold value variably setting device and the pressure determination signal output by the pressure determination element during the prescribed period for ejection abnormality determination; and a measurement device which extracts the second ejection abnormality factor by measuring a time interval of the pulses generated by the pulse generation device.

2. An ejection abnormality factor extraction method for a liquid ejection head including a nozzle which ejects liquid, a pressure chamber which is connected to the nozzle and is to be filled with the liquid, a pressure generating element which pressurizes the liquid in the pressure chamber, and a pressure determination element which determines a pressure inside the pressure chamber and outputs a pressure determination signal, the method comprising the steps of:

extracting a first ejection abnormality factor by previously storing, in a prescribed storage device, a peak value of the pressure determination signal output by the pressure determination element in a state where the nozzle ejects the liquid normally, and by comparing the peak value stored previously in the prescribed storage device with the pressure determination signal output by the pressure determination element during a prescribed period for ejection abnormality determination;

setting a threshold value for extracting a second ejection abnormality factor according to a differential between the peak value stored previously in the prescribed storage device and a peak value of the pressure determination signal output by the pressure determination element during the prescribed period for ejection abnormality determination;

generating pulses according to a comparison result between the threshold value and the pressure determination signal output by the pressure determination element during the period for ejection abnormality determination; and extracting the second ejection abnormality factor by measuring a time interval of the pulses.

* * * * *